US007233758B2

(12) United States Patent
Osada et al.

(10) Patent No.: US 7,233,758 B2
(45) Date of Patent: Jun. 19, 2007

(54) DEVELOPING APPARATUS FEATURING A DEVELOPER CARRYING MEMBER WITH AN ELASTIC SURFACE LAYER

(75) Inventors: Hikaru Osada, Mishima (JP); Kouichi Okuda, Tokyo (JP); Yasushi Shimizu, Suntoh-gun (JP); Yasunori Chigono, Susono (JP); Kenya Ogawa, Mishima (JP); Shuji Moriya, Suntoh-gun (JP); Kazunari Hagiwara, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 163 days.

(21) Appl. No.: 11/011,119

(22) Filed: Dec. 15, 2004

(65) Prior Publication Data

US 2005/0152718 A1 Jul. 14, 2005

(30) Foreign Application Priority Data

Dec. 15, 2003 (JP) ..... 2003-416768

(51) Int. Cl.
*G03G 15/08* (2006.01)

(52) U.S. Cl. ..... 399/252; 399/267; 399/275

(58) Field of Classification Search ..... 399/222, 399/252, 267, 270, 274, 275, 276; 430/106.1, 430/106.2, 110.1, 110.3
See application file for complete search history.

(56) References Cited

U.S. PATENT DOCUMENTS

| | | | | |
|---|---|---|---|---|
| 4,281,329 | A | 7/1981 | Yano et al. | 346/1.1 |
| 4,286,543 | A | 9/1981 | Ohnuma et al. | 118/657 |
| 4,292,387 | A | 9/1981 | Kanbe et al. | 430/102 |
| 4,395,476 | A | 7/1983 | Kanbe et al. | 430/102 |
| 4,473,627 | A | 9/1984 | Kanbe et al. | 430/102 |
| 4,913,088 | A | 4/1990 | Kanbe et al. | 118/651 |
| 5,032,485 | A | 7/1991 | Kanbe et al. | 430/120 |
| 5,044,310 | A | 9/1991 | Kanbe et al. | 118/653 |

(Continued)

FOREIGN PATENT DOCUMENTS

EP 1 316 852 A2 6/2003

(Continued)

OTHER PUBLICATIONS

Patent Abstracts of Japan, Publication No. 63235953, Sep. 30, 1988.

(Continued)

*Primary Examiner*—Robert Beatty
(74) *Attorney, Agent, or Firm*—Fitzpatrick, Cella, Harper & Scinto

(57) ABSTRACT

A developing device includes a rotatable developer carrying member for carrying a developer to develop an electrostatic image formed on an image bearing member with the developer; non-rotatable magnetic field generating means, disposed inside the developer carrying member, for magnetically attracting the developer on the developer carrying member; a regulating member for regulating an amount of the developer carried on the developer carrying member, wherein the developer carrying member is provided with a surface elastic layer, and the developer carrying member is press-contacted to the image bearing member, and wherein, the developer is an one component magnetic toner having an average circularity not less than 0.965, and an amount of the developer per unit area of the developer regulated by the regulating member is 5-14 g/m$^2$, and an amount of electric charge thereof is 10-50 μC/g.

19 Claims, 14 Drawing Sheets

U.S. PATENT DOCUMENTS

| | | | | |
|---|---|---|---|---|
| 5,096,798 | A | 3/1992 | Kanbe et al. | 430/120 |
| 5,122,838 | A | 6/1992 | Kohyama | 355/269 |
| 5,194,359 | A | 3/1993 | Kanbe et al. | 430/120 |
| 5,570,166 | A | 10/1996 | Ohzeki et al. | 355/251 |
| 5,708,921 | A | 1/1998 | Yagi et al. | 399/98 |
| 6,128,456 | A | 10/2000 | Chigono et al. | 399/176 |
| 6,447,969 | B1 * | 9/2002 | Ito et al. | 430/106.3 |
| 6,463,245 | B1 | 10/2002 | Suwa et al. | 399/274 |
| 6,465,144 | B1 * | 10/2002 | Hashimoto et al. | 430/106.1 |
| 6,630,275 | B2 | 10/2003 | Hiratsuka et al. | 430/106.1 |
| 6,829,454 | B2 * | 12/2004 | Miyakawa et al. | 399/159 |
| 6,847,796 | B2 | 1/2005 | Chigono et al. | 399/174 |
| 6,879,793 | B2 * | 4/2005 | Chiba et al. | 399/149 |
| 2004/0248025 | A1 * | 12/2004 | Miyakawa | 430/107.1 |

FOREIGN PATENT DOCUMENTS

| | | | |
|---|---|---|---|
| JP | 54-43027 | | 4/1979 |
| JP | 55-18656 | | 2/1980 |
| JP | 58-97071 | | 6/1983 |
| JP | 63-235953 | | 9/1988 |
| JP | 3-4276 | | 1/1991 |
| JP | 4-15949 | | 3/1992 |
| JP | 7-28335 | | 1/1995 |
| JP | 07-120115 | A * | 12/1995 |
| JP | 8-137257 | | 5/1996 |
| JP | 2598131 | | 1/1997 |
| JP | 9-80917 | | 3/1997 |
| JP | 10-307455 | | 11/1998 |
| JP | 2001-92201 | | 4/2001 |
| JP | 2001-235899 | | 8/2001 |
| JP | 3225759 | | 8/2001 |
| JP | 2001235897 | A * | 8/2001 |
| JP | 2002-341590 | | 11/2002 |
| JP | 2002-365828 | | 12/2002 |
| JP | 2003043736 | A * | 2/2003 |

OTHER PUBLICATIONS

Patent Abstracts of Japan, Publication No. 2002365828, Dec. 18, 2002.

Pending U.S. Appl. No. 11/011,145, filed Dec. 15, 2004, Hagiwara et al.

Pending U.S. Appl. No. 11/091,823, filed Mar. 29, 2005, Hagiwara et al.

An Abstract for a corresponding Japanese Patent Document No. 58-97071 has been provided.

An Abstract for a corresponding Japanese Patent Document No. 8-137257 has been provided.

* cited by examiner

C : COMPARISON EXAMPLE
E : EMBODIMENT

DEVELOPING APPARATUS FEATURING A DEVELOPER CARRYING MEMBER WITH AN ELASTIC SURFACE LAYER

FIELD OF THE INVENTION AND RELATED ART

The present invention relates to a developing apparatus for developing an electrostatic latent image formed on an image bearing member, with the use of developer. More specifically, it relates to a developing apparatus of a contact type, which develops an electrostatic latent image formed on an image bearing member, with the use of single-component developer.

This type of a developing apparatus can be used as the developing means for a process cartridge for developing an image bearing member such as an electrophotographic photosensitive member, an electrostatically recordable dielectric member, etc., and also, as the developing means for an image recording apparatus (image forming apparatus) such as a copying machine, a printer, etc.

For example, in an electrophotographic image forming apparatus, an electrostatic latent image formed on an electrophotographic photosensitive member, as a member (image bearing member) on which an image is formed, is developed with the use of single-component developer. As for the single-component developing method, there has been widely known (1) a nonmagnetic developing method of a contact type, and (2) a magnetic developing method of a noncontact type.

(1) Nonmagnetic Contact Developing Method

There has been proposed a developing method which develops an electrophotographic latent image by coating a development roller (developer bearing member), having a dielectric layer, with nonmagnetic developer, and placing the layer of the nonmagnetic developer on the development roller in contact with the peripheral surface of the photosensitive member (for example, Japanese Laid-open Patent Application 2001-92201). The developer in a developing apparatus (which hereinafter may be referred to as developing device) is supplied to a development roller with the use of a mechanical stirring system, or gravity. Further, a developing apparatus is provided with an elastic roller, which conveys the developer, and supplies the development roller with the developer. For the purpose of evenly coating the development roller with the developer, the elastic roller is also given the role of removing the developer remaining on the development roller, that is, the developer which did not transfer onto the photosensitive member. Between the substrate of the photosensitive member and the development roller, DC bias is applied.

(2) Magnetic Noncontact Developing Method

This method (for example, Japanese Laid-open Patent Applications 54-43027 and 55-18656) uses single-component magnetic developer, and a development sleeve (development bearing member) containing a magnet. Single-component magnetic developer is coated on the peripheral surface of the development sleeve, and the development roller is positioned so that a predetermined minute gap is present between the developer layer on the development roller and the peripheral surface of the photosensitive member. A latent image on the peripheral surface of the photosensitive member is developed by causing the developer to fly (jump) across this minute gap. As the developer in the developing device is conveyed to the development sleeve by the mechanical stirring system or gravity, it is coated on the development sleeve by a certain amount of the magnetic force from the magnet. After being coated on the development roller, the body of the developer on the development roller is formed by a regulating member into a uniform layer of the developer with a predetermined thickness to be used for development. Not only is the magnetic force from the magnet used for conveying the developer, but also, is used for another purpose in the development station. More specifically, the magnetic force is utilized for preventing the formation of unsatisfactory images, for example, an image suffering from the so-called fog attributable to the transfer of developer onto the unintended portions (non-image portion, that is, white (blank) areas of image) of a recording medium, in the development station. In other words, during development, the developer is subjected to the magnetic force from the magnet in the development roller, which acts in the direction to pull the developer toward the development roller. As the force for causing the developer to jump through the aforementioned gap, a combination of DC and AC biases is used. The DC bias is set to a value between the potential level of a developer attracting point (image portion) and the potential level of a developer repelling point (non-image portion). With the addition of the AC voltage, the potential level of the development bias sometimes exceeds that of the image portion, and sometime falls below that of the non-image portion, causing thereby the developer to shuttle between the development roller and the image portion, and also, between the development roller and non-image portion, while developing the latent image on the photosensitive member.

(3) Cleaner-Less (Toner Recycling) System

For the simplification of apparatus structure, and the elimination of waste, such an electrophotographic process that recycles toner, and therefore, does not require a drum cleaner, or a cleaning means, dedicated to the cleaning of the peripheral surface of a photosensitive member of an image forming apparatus of a transfer type, has been proposed. For example, there has been proposed an image forming apparatus which employs the above described nonmagnetic contact developing method, and utilizes the characteristics of this developing method to recover the residual developer, that is, the developer remaining on the development roller after development, at the same time and location as a latent image on the photosensitive member is developed (for example, Japanese Patent 2598131).

Further, there has been proposed an image forming apparatus which recovers the residual developer, or the developer remaining on the peripheral surface of a photosensitive member after image transfer, by utilizing the characteristics of the above described magnetic noncontact developing method (for example, Japanese Laid-open Patent Application 10-307455).

However, the abovementioned nonmagnetic contact developing method (1) has been problematic in that it is inferior in terms of the fog prevention. That is, as toner is repeatedly stripped away from the development roller by the elastic roller, it deteriorates in certain properties, for example, the ability to be frictionally charged, contributing thereby to the exacerbation of the fog. Incidentally, "fog" means the phenomenon that toner slightly adheres to the white (unexposed) areas, that is, the areas to which toner was not intended to be adhered, causing the resultant image to appear as if its white (blank) portions were soiled. As for the means for preventing the toner from deteriorating certain in properties, it is possible to reduce the amount of the friction generated by the elastic roller. However, if the amount of the friction generated by the elastic roller is too small, there is the possibility that an image suffering from "ghost" will be formed. "Ghost" means the phenomenon that the pattern formed on the peripheral surface of the development roller by toner consumption during a given image developing rotation of the development roller emerges like a ghost across the half-tone areas of the portion of an image being formed during the following rotations of the development roller. Thus, the ghostly pattern repeats itself across an image (transfer medium) with intervals which match the circumferential dimension of the development roller, resulting in the formation of an image irregular in density. Further, the presence of a ghost means that a certain amount of the residual toner was not stripped from the development roller.

Thus, the nonmagnetic contact developing method in accordance with the prior art is not desirable, from the standpoint of the toner deterioration in certain properties, in that the toner on the development roller is continuously subjected to the friction caused by the elastic roller. In terms of the adjustment of the friction generated by the elastic roller, hot only do the prevention of a fog and the prevention of a ghost contradict each other, but also, the prevention of a ghost has its own contradictory factors.

Further, the toner deterioration also created the problem that toner was easily affected by being circulated in the developing device. More specifically, as toner was circulated, mechanically or by gravity, in the developing device, the body of toner in the adjacencies of the peripheral surface of the development roller was barely moved; in other words, the areas in which toner was not replaced were created in the adjacencies of the peripheral surface of the development roller. Meanwhile, the toner in the area in which toner was circulated was deteriorated by a certain amount in certain properties. Then, as the entire body of the toner in the developing device reduced in volume, these two bodies of toner different in properties mixed with each other, resulting in the formation of an image unsatisfactory in that it suffered from the above described problem of fog, which was attributable to toner agglomeration, in addition to the problem attributable to the elastic roller itself. From the standpoint of the toner stripping performance of the elastic roller, a sponge roller was used as the elastic roller. However, a sponge roller has been problematic in that developer was compressed into the cells of the sponge, being thereby agglomerated. Thus, there was the possibility that the larger particles of the toner resulting from the agglomeration of the toner would emerge to the surface of the sponge roller, contributing to the formation of a defective image, in particular, an image having its defects across its half-tone areas.

On the other hand, the usage of the cleaner-less method allowed paper dust to enter the elastic roller (sponge roller), resulting sometimes in the formation of such an image that suffered from the defects which repeated themselves, with such intervals that matched the circumferential dimension of the elastic roller.

In comparison, in the case of the abovementioned magnetic noncontact developing method, there is the problem of the formation of an image suffering from the defects attributable to the magnetic brush, more specifically, the defect that the vertical fine lines are different in uniformity from the horizontal fine lines. That is, the fine lines parallel to the direction parallel to the moving direction of the magnetic brush relative to the peripheral surface of the photosensitive member (photosensitive drum) are satisfactorily developed in terms of uniformity, whereas the fine lines perpendicular to the moving direction of the magnetic brush are likely to be unsatisfactorily developed in that they sometimes appear discontinuously. Also in the case of the magnetic noncontact developing method, an image suffering from edge defects are sometimes formed. More specifically, the edges of the high density areas are more densely developed, in particular, on the downstream side in terms of the processing direction, whereas the edges of the half-tone areas adjacent to the high density areas are lightly developed. The cause for this phenomenon is thought to be that the development roller is not placed in contact with the photosensitive member, and also, that for the development of a latent image on the photosensitive member, developer particles are made, by the AC electrical field, to shuttle between the development roller and photosensitive member. More specifically, in the development station, toner particles are moved in the direction parallel to the plane of the development roller (photosensitive member); not only are they moved to the edges of the high density areas from within the high density areas, but also, from outside the high density areas. As a result, image defects such as the above described ones occur. Further, a cleaner-less image forming apparatus employs the noncontact developing method. Therefore, it is relatively low in its performance to recover the toner on the photosensitive drum, suffering therefore the problem that the transfer residual toner forms ghosts in the solid white areas and half-toner areas of an image as the image is developed, as well as the problem that an image having black spots (which hereinafter) will be referred to as white spots) in its solid black areas is formed. It is thought that these white spots are likely to be formed as paper dust enters the gap between the development roller and photosensitive drum, because the presence of paper dust between the development roller and photosensitive drum allows the occurrences of bias leak between the development roller and photosensitive drum, allowing thereby the latent image on the photosensitive drum to increase in potential level (shift in negative direction).

Further, the contact developing apparatus in accordance with the prior art sometimes produces an image having defects in its solid white areas. These defects repeat themselves across the image (transfer medium) with such intervals that match the dimension of the development roller in terms of the circumferential direction, and are as wide as several millimeters. The cause of these defects is thought to be that as developer particles enter the contact area between the development roller and photosensitive drum, they are pressed by the roller and drum, being thereby more firmly adhered to the development roller in terms of electrostatic adhesion than in the case of the noncontact developing apparatus.

Moreover, there is the problem of the scattering of toner. That is, as the force which keeps the developer held to the development roller reduces, toner scatters within the developing apparatus (hence, image forming apparatus), causing various problems.

SUMMARY OF THE INVENTION

The primary object of the present invention is to solve the above described problems to provide a developing apparatus superior to a developing apparatus in accordance with the prior art, in that it does not suffer from the above described problems.

Another object of the present invention is to prevent developer from deteriorating in certain properties, in order to provide a developing apparatus which does not yield an image suffering from fog.

Another object of the present invention is to provide a developing apparatus which does not yield an image having defects in its half-tone areas.

Another object of the present invention is to provide a developing apparatus which does not yield an image suffering from ghosts.

Another object of the present invention is to provide a developing apparatus which does not yield an image having defects in its solid white areas.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Image Recording Apparatus in Embodiment 1

Figure 1:
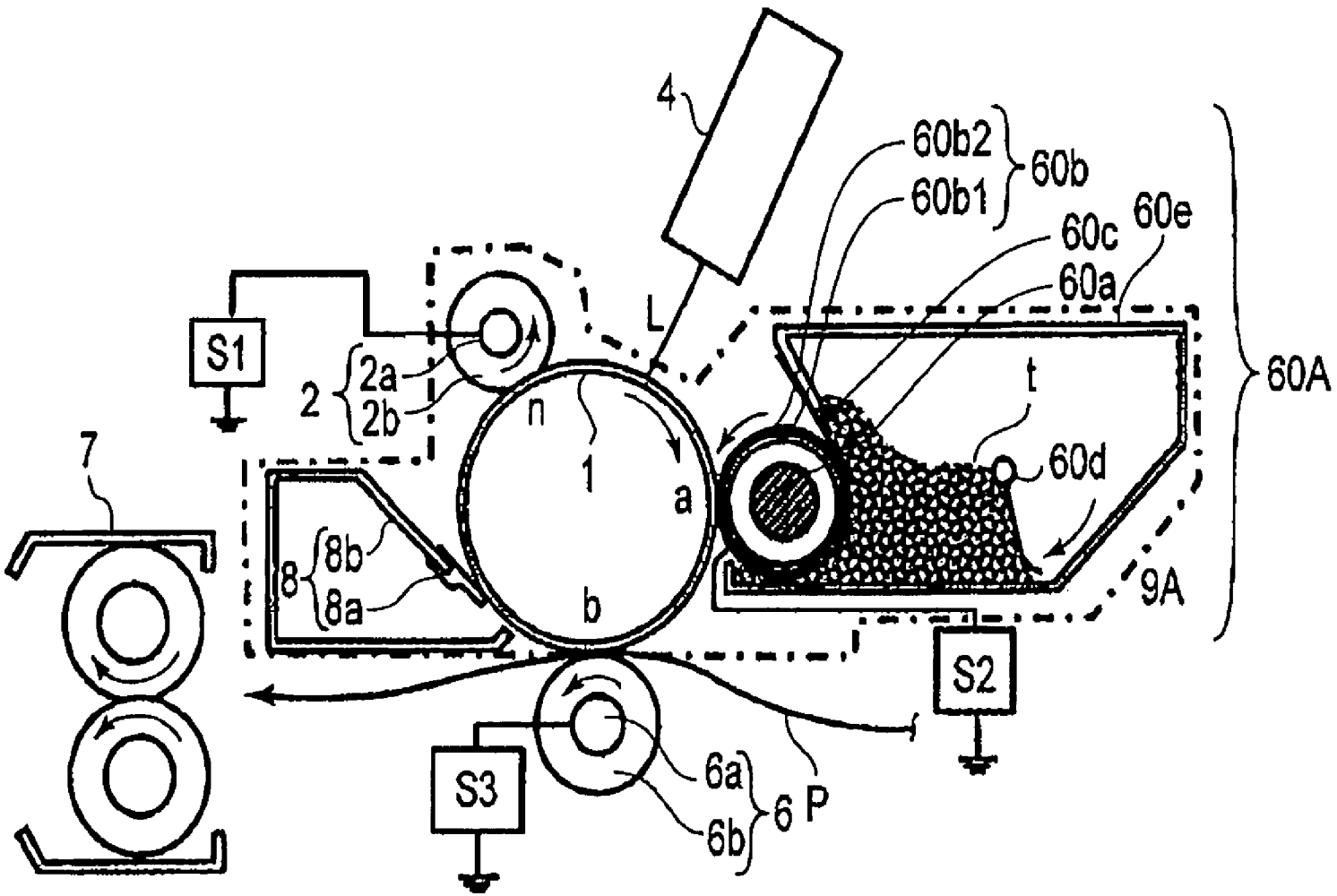
FIG. 1 is a schematic drawing of a developing apparatus of scheme 1 according to a first embodiment of the present invention, showing the general structure thereof.

FIG. 1 is a schematic drawing of an image recording apparatus (image forming apparatus) employing one of the developing apparatuses in accordance with the present invention, showing the general structure thereof. This image forming apparatus is a laser printer of a transfer type, which employs an electrophotographic process.

(1) General Structure of Image Recording Apparatus

Designated by a referential number 1 is an image bearing member (object to be developed). The image bearing member 1 in this embodiment is in the form of a rotatable drum (hereinafter, it will be referred to as photosensitive drum). It is a photosensitive member of an OPC type, and its inherent polarity is negative. It is 24 mm in diameter. This photosensitive drum 1 is rotationally driven in the clockwise direction indicated by an arrow mark, at a constant peripheral velocity (process speed PS; printing speed) of 85 mm/sec.

Designated by a referential number 2 is a charge roller as a charging means. This charge roller 2 is an electrically conductive elastic roller, comprising a metallic core 2*a* and an electrically conductive elastic layer 2*b*. It is kept pressed on the photosensitive drum 1 with the application of a predetermined amount of pressure, forming a charging station n between the charge roller 2 and photosensitive drum 1. In this embodiment, the charge roller 2 is rotated by the rotation of the photosensitive drum 1.

Designated by a referential symbol S1 is a power source for applying charge bias to the charge roller 2. In this embodiment, DC voltage, the potential level of which is higher than the charge start voltage, is applied to the contact area between the charge roller 2 and photosensitive drum 1 from the charge voltage power source S1. More specifically, a DC voltage of −1,300 V is applied as the charge bias to the charge roller 2, which is in contact with the photosensitive drum 1, in order to uniformly charge the peripheral surface of the photosensitive drum 1 to a potential level of −700 V (potential level of unexposed point).

Designated by a referential number 4 is a laser scanner (exposing apparatus) having laser diodes, polygon mirrors, etc. This laser beam scanner is for outputting a beam L of laser light, while modulating it in intensity with sequential electrical digital image formation pixel signals, in order to scan (expose) the uniformly charged peripheral surface of the aforementioned rotational photosensitive drum 1. The intensity of the beam L of the laser light is adjusted so that as a given one of the numerous points of the peripheral surface of the photosensitive drum 1 is exposed to the beam L of laser light, the potential level of this point of the photosensitive drum 1 changes to −150 V.

Thus, as the peripheral surface of the photosensitive drum 1 is scanned (exposed) by the beam L of laser light, an electrostatic latent image in accordance with the data of an intended image is formed on the peripheral surface of the photosensitive drum 1.

Designated by a referential number 60A is a developing apparatus (developing device) in the first version of the image forming apparatus which will be described later. The toner t is frictionally charged, and is made to develop, in the development station, the electrostatic latent image on the photosensitive drum 1, by the development bias applied between the developing sleeve 60*b*, as a developer bearing member (developer bearing carrying member), and the photosensitive drum 1, by the development bias application power source S2. The developing apparatus 60A will be described later in detail when the following versions of the embodiments of the present invention, and the versions of the comparative embodiments, are described.

Designated by a referential number 6 is a transfer roller as a transferring means of a contact type, the electrical resistance of which is in the mid range. The transfer roller 6 is kept in contact with the photosensitive drum 1 with the application of a predetermined amount of pressure, forming a transfer nip b. To this transfer nip b, a recording medium P, as an object on which recording is made, is delivered with a predetermined timing from an unshown sheet feeding station, while a predetermined transfer bias is applied to the transfer roller from a transfer bias application power source S3. As a result, the toner image on the photosensitive drum side are sequentially and continuously transferred onto the surface of the transfer medium P, as the transfer medium is conveyed S through the transfer nip b.

The transfer roller 6 in this embodiment comprises: a metallic core 6*a*, and a layer 6*b* of foamed substance, the electrical resistance of which is in the mid range. The electrical resistance of the transfer roller 6 is $5\times10^8$ Ω. The transfer is caused by applying a voltage of +2.0 kV to the metallic core 6*a*. After being guided into the transfer nip b, the transfer medium P is conveyed through the transfer nip b while remaining pinched by the transfer roller 6 and photosensitive drum 1. As a result, the toner image on the peripheral surface of the photosensitive drum 1 is continually transferred onto the surface of the transfer medium P by the electrostatic force and the pressure in the transfer nip b.

Designated by a referential number 7 is a fixing apparatus which employs a thermal fixing method, or the like. After the transfer of the image on the peripheral surface of the photosensitive drum 1 onto the transfer medium P having been delivered to the transfer nip b, the transfer medium P is separated from the peripheral surface of the photosensitive drum 1, and is introduced into the fixing apparatus 7, in which the toner image is fixed to the transfer medium P. Thereafter, the transfer medium P is discharged as a copy from the main assembly of the image forming apparatus.

Designated by a referential number 8 is a cleaning apparatus (drum cleaner) for cleaning the photosensitive drum 1. The cleaning apparatus 8 scrapes the peripheral surface of the photosensitive drum 1, with the cleaning blade 8*a*, removing thereby the residual toner, or the toner remaining on the peripheral surface of the photosensitive drum 1, from the peripheral surface of the photosensitive drum 1, after the image transfer, and recovers the toner it removed, into a waste toner container 8*b*.

After the cleaning of the peripheral surface of the photosensitive drum 1, the photosensitive drum 1 is recharged by the charging apparatus 2, and used for the next image formation.

Designated by a referential symbol 9A is a process cartridge, which comprises; a cartridge in which the photosensitive drum 1, charge roller 2, developing apparatus 60A, and drum cleaner 8 are integrally disposed, and which is removably mountable in the main assembly of the image forming apparatus.

Image Recording Apparatus in Embodiment 2

Figure 2:
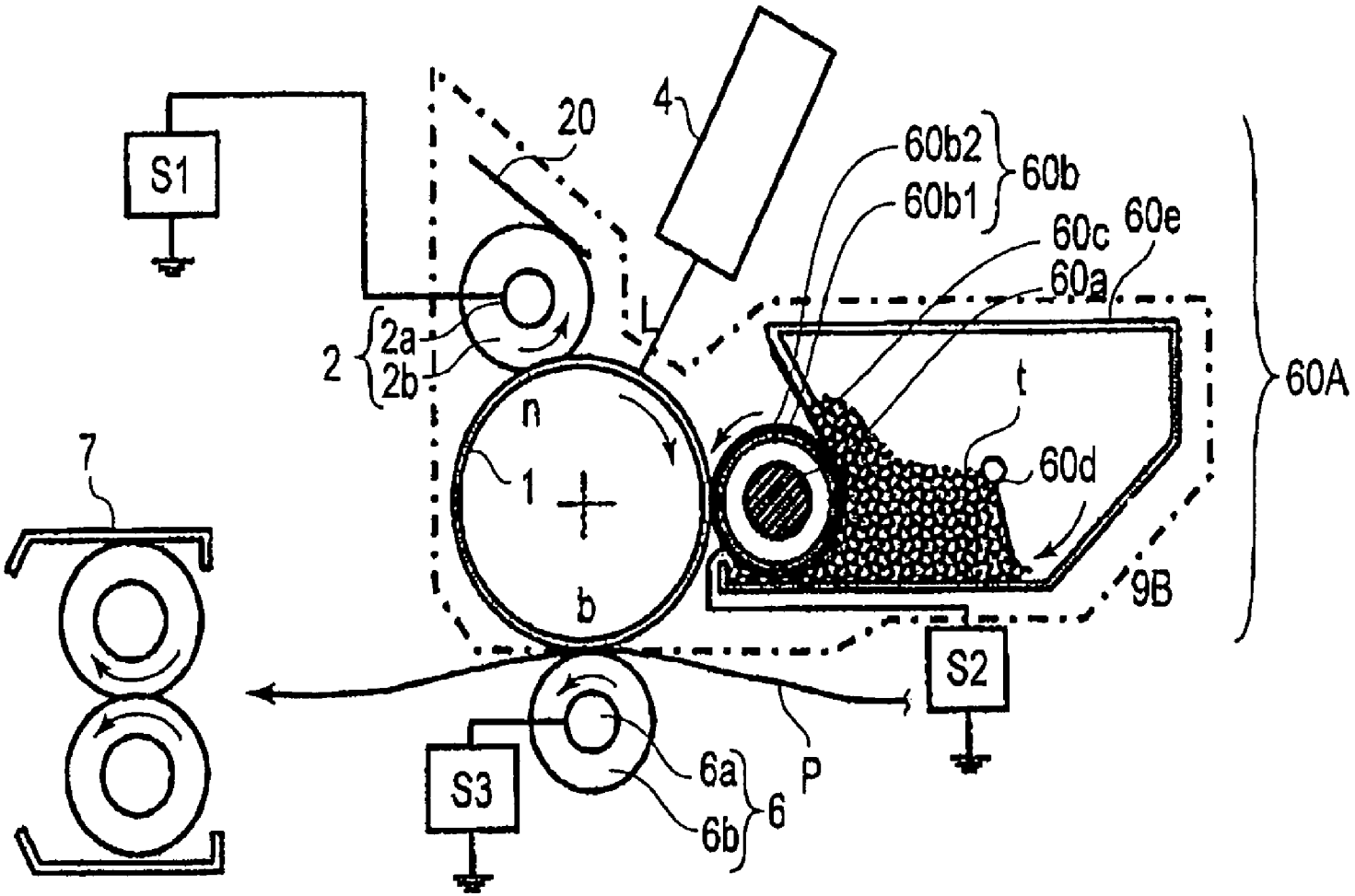
FIG. 2 is a schematic drawing of a developing apparatus of scheme 2 according to a second embodiment of the present invention, showing the general structure thereof.

FIG. 2 is a image recording apparatus employing the developing apparatus in the second embodiment of the present invention, showing the general structure thereof. The image recording apparatus in this embodiment is a laser printer of a transfer type, which employs an electrophotographic process as well as a toner recycling process (cleanerless system). Next, only the features of this image forming apparatus different from those of the image forming apparatus in the first embodiment will be described; the features similar to those of the image forming apparatus in the first embodiment will not be described.

The most essential difference of the image forming apparatus in this embodiment from the image forming apparatus in the first embodiment is that this image forming apparatus is not equipped with the drum cleaner 8 shown in FIG. 1, and the transfer residual toner is recycled. In order to prevent the transfer residual toner from derogatorily affecting the other processes such as the charging process, the transfer residual toner is re-circulated and is recovered into the developing apparatus 60A. More specifically, the following structural changes are made to the image forming apparatus in the first embodiment.

As for the charging of the photosensitive drum 1, a charge roller 2 identical to the charge roller 2 in the first embodiment is employed. In this embodiment, however, the charge roller 2 is independently driven. The revolution of the charge roller 2 per unit length of time is adjusted so that the peripheral velocity of the charge roller 2 matches the peripheral velocity (process speed) of the photosensitive drum 1. With the charge roller 2 being driven independently from the photosensitive drum 1, it is assured that the charge roller 2 remains in contact with the photosensitive drum 1 and a charge roller contacting member 20 to charge the toner to the negative polarity (normal polarity). Further, another reason the charge roller 2 is providing with the contacting member 20 is for preventing the charge roller 2 from remaining contaminated. With the provision of this contacting member 20, even if the charge roller 2 is contaminated with toner which is opposite (positive) in polarity to the polarity of the charge roller 2, the contaminantive toner is changed in polarity from the positive to the negative, so that it will be swiftly ejected from the charge roller 2 to be recovered into the developing apparatus 60A at the same time and location as a latent image on the photosensitive drum 1 is developed by the developing apparatus 60A. The contacting member 20 is formed of a polyimide film with a thickness of 100 μm, and is placed in contact with the charge roller 2 so that a linear pressure of 10 (N/m) will be maintained between the contacting member 20 and charge roller 2. The reason for the usage of polyimide is that polyimide has the property of frictionally charging toner to the negative polarity.

Designated by a referential symbol 9B is a process cartridge in which the photosensitive drum 1, charge roller 2, charge roller contacting member 20, and developing apparatus 60A are integrally disposed, and which is structured so that it can be removably mounted into the main assembly of the image forming apparatus.

Developing Apparatuses in Embodiments of Present Invention, and Comparative Embodiments

[Version 1 of Developing Apparatus]

(Sphericity: 0.976, B/A: 0.001)

The first version of the developing apparatus 60 in the preferred embodiments of the present invention (FIGS. 1 and 2) will be described.

Designated by a referential number 60*b* is a development sleeve as a rotatable developer bearing member (developer bearing-carrying member), in which a magnetic roll 60*a* as a magnetic field generating means is solidly and nonrotationally disposed. The development sleeve 60*b* comprises: an aluminum cylinder 60*b*1, and a layer 60*b*2 of nonmagnetic and electrically conductive substance placed on the peripheral surface of the aluminum cylinder 60*b*1. It is kept in contact with the photosensitive drum 1 with the application of a predetermined amount of pressure.

The pressure between the photosensitive drum 1 and the developing sleeve 60*b* is adjusted at 200 N/m (drawing pressure). The pressure between the photosensitive drum and the developing sleeve is preferably 50-3000 N/m (drawing pressure).

Here, the drawing pressure is a pressure value corresponding to a line pressure and is a force per 1 m required to draw a SUS (stainless steel) plate of 30 μm thick sandwiched between two SUS plates each having a thickness of 30 μm.

If the drawing pressure is not less than 3000 N/m, remarkable scraping of the surface of the image bearing member and/or deterioration of the developer, and therefore, image defects result. If it is not more than 50 N/m, the size of the developing zone is not sufficient, with the result that transition of the developer from the developer carrying member onto the image bearing member is not sufficient, and therefore, image defects result.

The developing sleeve 60*b* of this embodiment is manufactured by kneading a material for the non-magnetic electroconductive elastic layer 60*b*2, extruding the kneaded material, bonding the extruded material on an aluminum sleeve 60*b*1 into a layer 60*b*2, and abrading the bonded layer 60*b*2 into a thickness of 500 μm. The developing sleeve 60*b* has a microhardness of 95°, and a surface roughness Rz of 3.8 μm and a surface roughness Ra of 0.6 μm. The elastic layer preferably has a microhardness of 40-98°.

In this embodiment, the surface hardness has been measured using a microhardness meter Asker MD-1F360A, available from Kobunshi Kabushiki Kaisha, Japan. If the microhardness is not more than 40, the scraping and damage of the surface of the elastic layer is extremely remarkable due to the sliding contact with the regulating member, the image bearing member and the like, and therefore, image defects result. For this reason, it is preferably not less than 40. If, however, it exceeds 98, the scraping and/or damage of the image bearing member occurs due to the sliding contact with the image bearing member resulting in image defects. Therefore, it is preferably not more than 98.

The surface roughness has been measured using a surfcorder SE3400, available from KOSAKA KENKYUSHO Kabushiki Kaisha, Japan, with contact detecting unit PU-DJ2S under the condition of the measurement length of 2.5 mm, the perpendicular direction magnification of 2000 times, the horizontal direction magnification of 100 times, the cut-off level of 0.8 mm and the filter setting of 2 CR, and the leveling setting of front data.

A magnet roller 60*a* is a fixed magnet functioning as magnetic field generating means for generating magnetic forces at the predetermined positions on the developing sleeve 60*b*. It generates a magnetic flux density having a peak density of 700 G (absolute value) at each of the positions of a developing zone a, a feeding portion, a supply portion and a collecting portion.

The maximum value of the intensity of the magnetic flux density in the direction perpendicular to the surface of the developer carrying member is preferably approximately 200-1500 G, and further preferably 500-900 G.

More particularly, the peak densities of the magnetic poles are generated at the positions of the developing zone, the collecting portion, the supply portion, the feeding portion and the developing zone in the order named. The toner carried to the developing zone is used for development at the developing zone, and the toner not consumed in the developing zone is collected back into the developing container by a collecting portion disposed downstream of the developing zone. In the collecting portion, means is provided to prevent blowing of the toner from the inside of the developing device.

In this manner, the toner reaching the collecting portion is fed to the supply portion disposed downstream of the collecting portion in the developing container with respect to the developer carrying direction. In the supply portion, the toner having reached the collecting portion is mixed with the supplied toner, and is carried to a feeding portion disposed downstream of the supply portion, and is again fed to the developing zone, thus accomplishing continuous toner supply to the developing zone.

The magnetic flux density has been measured, in this embodiment, using Gauss meter, series 9900 with probe A-99-153, available from Bell. The Gauss meter has an axial probe in the form of a rod connected to the main assembly of the Gauss meter. The developing sleeve 60*b* is fixed in a horizontal position, and the magnet roller 60*a* is rotatable. To the developing sleeve 60*b*, the probe taking a horizontal attitude is perpendicularly disposed with a small gap, and the center of the developing sleeve 60*b* and the center of the probe are placed in the same horizontal plane. They are placed at such fixed positions, and the magnetic flux density is measured. The magnet roller 60*a* and the developing sleeve 60*b* are substantially concentric, and therefore, it is considered that clearance between the developing sleeve 60*b* and the magnet roller 60*a* are constant irrespective of the peripheral positions on the magnet roller 60*a*. In view of this, by measuring the magnetic flux density on the surface and in the normal line direction on the surface of the developing sleeve 60*b*, while rotating the magnet roller 60*b*, the measurement covers all the positions in the circumferential direction of the developing sleeve 60*b*. From the obtained magnetic flux density data in the peripheral directions, the peak strengths at each of the positions has been determined Resistance of electroconductive elastic layer of developing sleeve:

The resistance value of the electroconductive elastic layer provided at that surface of the developing sleeve, is preferably $10^2$-$10^8$ Ωcm. If it is less than $^2$ Ωcm, electrical leakage and/or decrease of the surface potential occurs with the result of image defect (fog) due to transfer of the toner to a non-printing portion of the image bearing member. If it exceeds $10^8$ Ω, an effective bias level of the developing bias is so small with the result of production of fog and/or the reduction of the image density.

In the employed measuring method, an electroconductive elastic layer is formed on the sleeve base layer, and in the state, a weight of 300 g is imparted at the opposite ends of the sleeve base layer. A bare tube of aluminum having a diameter which is the same as that of the image bearing member is contacted thereto, and then, the aluminum bare tube is rotated, by which the elastic sleeve is driven by the aluminum bare tube. A voltage of −400 V is applied between the core metal and the aluminum bare tube, and the current flowing through the aluminum bare tube is measured as a current flowing through the electroconductive elastic layer.

The resistance value of the electroconductive elastic layer is determined from the voltage applied to the sleeve base layer and the current through the aluminum bare tube.

Thickness of electroconductive elastic layer of elastic developing sleeve.

The thickness of the electroconductive elastic layer as the electroconductive developing sleeve is preferably not more than 50-2000 μm. If it is not more than 50 μm, the surface of the image bearing member is scraped and/or damaged with the result of image defect, and therefore, it is preferably not less than 50 μm. If it is not less than 2000 μm, the magnetic force applied to the surface of the image bearing member from the fixed magnetic field generating device disposed therein is so small that amount of the developer supplied is not enough to provide satisfactory images. Therefore, it is preferably not more than 2000 μm.

The toner t1 which is an one component magnetic toner t1 (developer) and is produced through a suspension polymerization method and has an average circularity of 0.976.

In the present invention, the average circularity is used as a simple methods quantitatively expressing the configurations of the toner particles. The average circularity has been determined using a flow type particle image analyzing apparatus available from Toa-Iyo Denshi Kabushiki Kaisha, Japan (FPIA-2100). Circularities (Ci) particles of a group of the particles having the circle-corresponding diameter of not less than 3 μm are obtained using the following equation (1), and the total sum of the circularities of all of the particles having been subjected to such equation (2):

Circularity($Ci$)=(length of circumference of a circle having a projection area which is the same as the particle)/(length of circumferene of a circle of a projection of the particle) (1)

$$\text{Average Cirdularity} = \sum_{i=1}^{m} Ci/m \quad (2)$$

The developer contains the same weights of the developer and magnetic particles and the binder resin to provide magnetic particles which can be conveyed by sufficiently strong magnetic force. The amount of the magnetic particle is 100 parts-by-weight relative to 100 parts-by-weight of the binder resin, but in the amount of the magnetic particle relative to the binder resin 100 parts-by-weight may be 70-120 parts-by-weight with which the advantages effects of the present invention can be provided.

The average particle size (D4) of the toner is 6 μm.

In this embodiment, the density δ of magnetic toner is 1.6. In this embodiment, the density of magnetic toner means a true density of the particle, and the true density has been measured using a dry type density meter Acupic 1330, available from Shimazu Seisakusho, Japan.

In this embodiment, the amount of magnetization of the magnetic toner σ is 30 $Am^2/kg$. In this embodiment, the amount of magnetization of the magnetic toner has been measured using vibration magnetic force meter VSM-3S-15, available from Toei Kogyo Kabushiki Kaisha, under 1 K oersted magnetic field.

An index indicative of an amount of the magnetic material exposed at the surface of the toner particles may be a ratio (B/A) between the content (A) of carbon element existing at the surface of the magnetic toner particle and the content of iron element (B), measured by X-ray photoelectron spectrum analysis (as disclosed in Japanese Laid-open Patent Application2001-235897 or the like). In this embodiment, the (B/A) of the toner t1 is 0.001. Such magnetic polymerized toner may be produced through the methods disclosed in Japanese Laid-open Patent Application2001-235899, for example.

In the process of being carried on the developing sleeve 60*b* under the influence of the magnetic force from the magnet roller 60*a*, the toner t1 is subjected to a layer thickness regulation of the regulating blade 60*c* (developer amount regulating member) for regulating the amount of the developer on the developing sleeve, and is also subjected to triboelectric charging. Designated by 60*d* is a stirring member for circulating the toner in the developing container 60*e* and feeding the toner sequentially into magnetic force reaching ranges around the surface of the sleeve.

The developing device 60A of in this example employs a regulating blade 60*c* which has a length of a free part of 2.5 mm and which is placed with a drawing pressure of 55 (N/m).

The length of the free part on the blade is a length from the contact portion of the regulating blade 60*c* relative to the developing sleeve 60*b*.

The toner t1 applied on the developing sleeve 60*b* is fed to the developing zone (developing zone portion) a where the developing sleeve 60*b* is opposed to the surface of the photosensitive drum 1, by the rotation of the developing sleeve 60*b*. The developing sleeve 60*b* its supplied with the developing bias voltage (DC voltage −450V) from a developing bias applying voltage source S2. The peripheral speed of developing sleeve 60*b* is 1.2 times the peripheral speed of the photosensitive drum 1. By doing so, the electrostatic latent image on the photosensitive drum 1 is developed with the toner t1 (reverse development). Here, the peripheral speed of the developing sleeve 60*b* relative to the photosensitive drum 1 is 1.2 times in this embodiment, but it may be different within a range of 1.0-2.0 times with which the advantageous effects of the present invention may be provided.

Embodiment of Developing Apparatus

Circularity=0.968, and B/A=0.01.

The structure of the developing device in this embodiment is substantially the same as that of the developing device 60A of Embodiment 1, but the toner t2 used here is different from the only used in Embodiment 1.

The toner t2 is an one component magnetic toner t2 produced by mixing and kneading binder resin, magnetic particle and charge control material through a surface improvement treatment and classification. It contains externally added material for fluidization (pulverization method known by Japanese Laid-open Patent Application 2002-341590, for example. The developer contains the same weights of the magnetic particles and the binder resin to provide magnetic particles which can be conveyed by sufficiently strong magnetic force. The toner has an average particle size (D4) of 6 μm and an average circularity 0.968 determined by the methods described in the foregoing.

The ratio (B/A) defined in the foregoing is 0.01.

Embodiment 3 of Developing Apparatus

Circularity=0.950, B/A=0.01.

The structure of the developing device in this embodiment is substantially the same as that of the developing device 60A of Embodiment 1, but the toner t3 used here is different from the only used in Embodiment 1.

The toner t3 is an one component magnetic toner produced by mixing and kneading binder resin, magnetic particle and charge control material through a surface improvement treatment and classification. It contains externally added material for fluidization (pulverization method), similarly to Embodiment 2. The developer contains the same weights of the magnetic particles and the binder resin to provide magnetic particles which can be conveyed by sufficiently strong magnetic force. The toner has an average particle size (D4) of 8 μm and an average circularity 0.950. Determined by the methods described in the foregoing.

The ratio (B/A) defined in the foregoing is 0.01.

Embodiment 4 of Developing Apparatus

Circularity=0.945, B/A=0.05.

Figure 4:
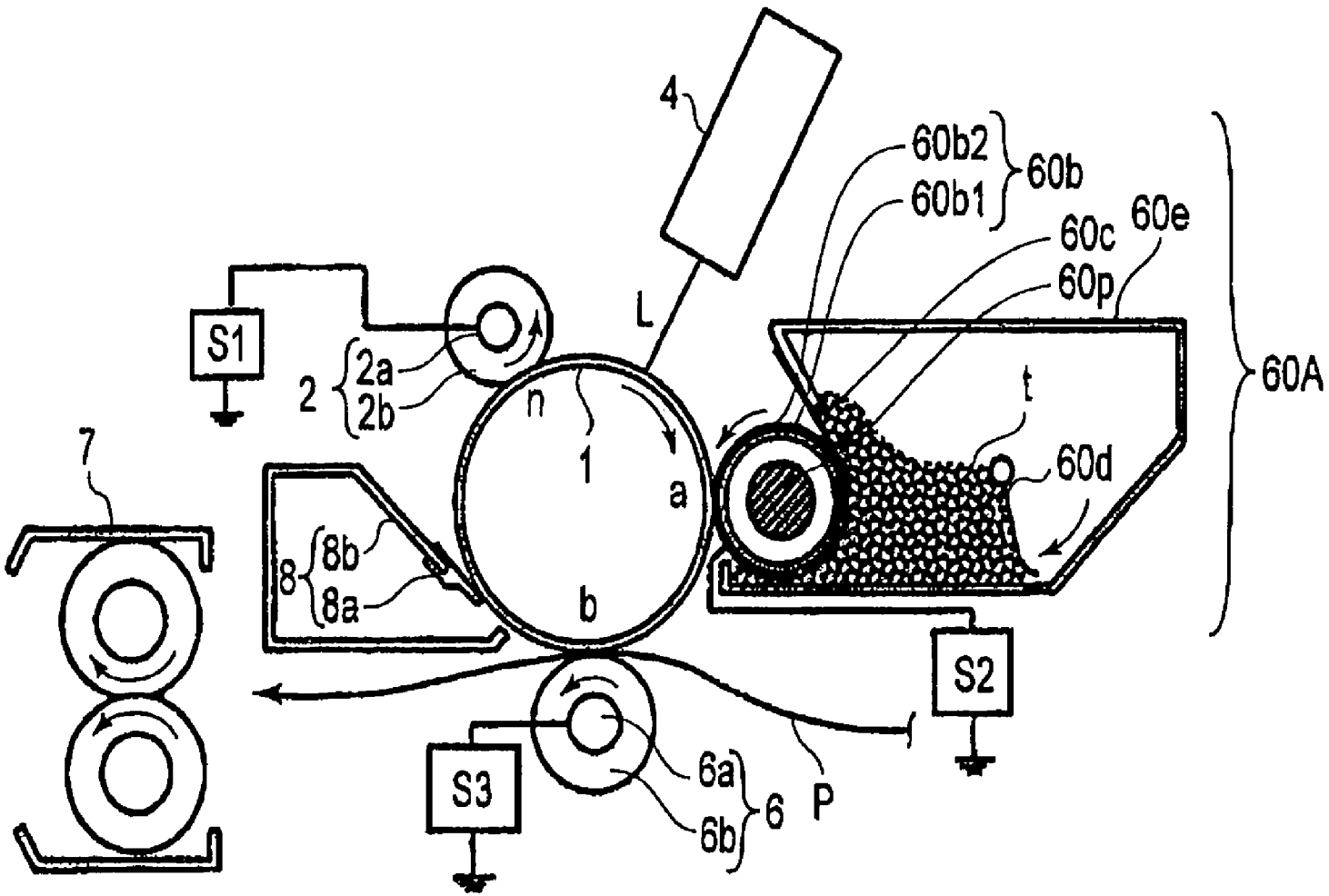
FIG. 4 is a schematic drawing a developing apparatus of scheme 1 according to a fourth embodiment of the present invention, showing the general structure thereof.

The structure of the developing device in this embodiment is substantially the same as that of the developing device 60A of Embodiment 3, but the magnet roller disposed within the developing sleeve is different. FIG. 4 is a schematic view of the developing apparatus of this embodiment.

The magnet roller 60*p* used in this embodiment is different from the magnet roller 60*a* used in the developing device 60A of FIG. 1 in the number of the magnetic poles and the surface magnetic flux densities. A magnet roller 60*a* is a fixed magnet functioning as magnetic field generating means for generating magnetic forces at the predetermined positions on the developing sleeve 60*b*. In this embodiment, the magnet roller 60*p* generates peak densities magnetic flux densities of 300 G (absolute value) at the feeding portion and the supply portion.

The used toner t4 is one component magnetic toner t4 and is produced by mixing and kneading binder resin, magnetic particle and charge control material through a pulverization and classification. It contains externally added material for fluidization (pulverization method). The developer contains the same weights of the magnetic particles and the binder resin to provide magnetic particles which can be conveyed by sufficiently strong magnetic force. The toner has an average particle size (D4) of 8 μm and an average circularity of 0.945, determined by the methods described in the foregoing.

The ratio (B/A) defined in the foregoing is 0.05.

COMPARISON EXAMPLE 1 OF DEVELOPING DEVICE

Figure 3:
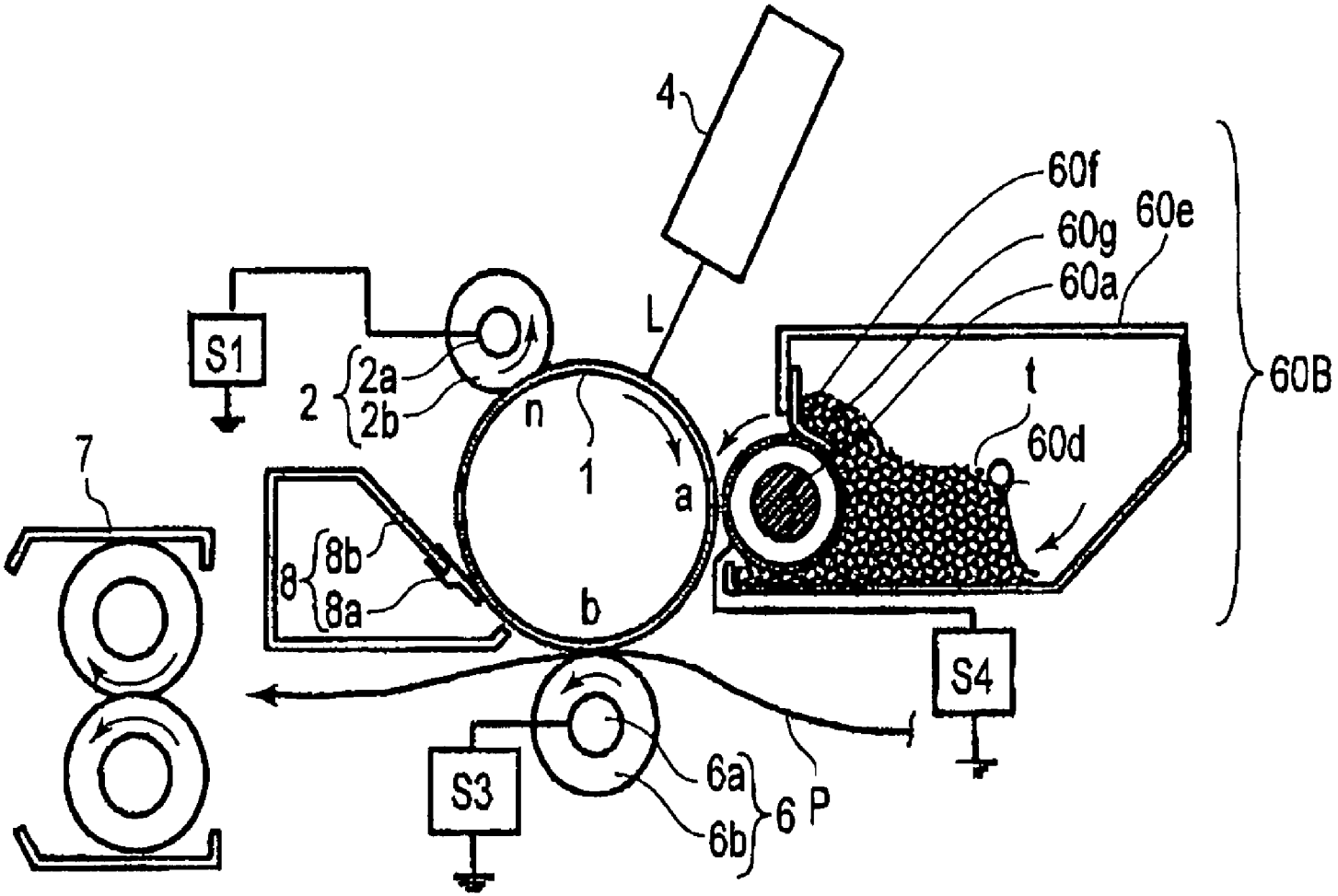
FIG. 3 is a schematic drawing of a developing apparatus of scheme 1 in comparison example 1, showing the general structure thereof.

A developing device 60B of comparison example 1 will be described. FIG. 3 is a schematic view of an image recording device using a developing device of comparison example of scheme 1 (a drum cleaner of FIG. 1 is employed). The developer use to hear is toner t4 which will be described hereinafter.

Designated by 60*f* is a developing sleeve as a developer carrying and feeding member enclosing a magnet roller 60*a*. The developing sleeve 60*f* compresses an aluminum cylinder and a non-magnetic electroconductive layer (unshown) on the aluminum cylinder and is disposed with a gap of 300 μm from the photosensitive drum 1. The developing sleeve 60*f* has a microhardness of 100°, a surface roughness Rz home 11.5 μm and a surface roughness Ra 1.5 μm.

The toner t4 filled in the developing device 60B is carried on the developing sleeve 60*f* while being subjected to the magnetic force provided by the magnet roller 60*a*, during which a layer thickness of the toner t4 is regulated by the regulating blade 60*g* and the toner t4 is triboelectrically charged. Designated by 60*d* is a stirring member for circulating the toner in the developing container 60*e* and feeding the toner sequentially into magnetic force reaching ranges around the surface of the sleeve The developing device 60B of this embodiment employs a regulating blade 60*g* which has a length of a free part of 1.2 mm and which is placed so that the drawing pressure is 30 (N/m).

The toner t4 applied on the developing sleeve 60*f* is carried by the rotation of the sleeve 60*a* to the developing zone (developing zone portion) where the sleeve 60*f* it opposed to the surface of the photosensitive drum 1. The sleeve 60*a* is supplied with a developing bias voltage (DC voltage of −450V superimposed with AC voltage of 1.8 kVpp, 1.6 kHz). The developing sleeve 60*f* is rotated at a peripheral speed which is 1.2 times the peripheral speed of the photosensitive drum 1.

In this manner, the electrostatic latent image on the photosensitive drum 1 is developed with the toner t4 (reverse development). The developer is toner t4.

The toner t4 is the same as the toner used in Embodiment 4.

COMPARISON EXAMPLE 2 OF DEVELOPING DEVICE

The fundamental structure of the developing device of comparison example 2 is substantially the same as that of comparison example 1, namely, developing device 60B (FIG. 3), but is different in the magnet roller enclosed in the developing sleeve 60*f*.

The magnet roller used in this embodiment is the same as the magnet roller 60*p*.

DEVELOPING DEVICE OF COMPARISON EXAMPLE 3

The developing device of comparison example 3 is the same as the developing device 60B of comparison example 1 except for the following.

The developing sleeve 60*f* is contacted the photosensitive drum 1 with a predetermined pressure. The pressure is such that drawing pressure between the photosensitive drum 1 and the developing sleeve 60*f* is 50 N/m. The developing bias applied is only DC voltage of −450V.

DEVELOPING DEVICE OF COMPARISON EXAMPLE 4 (MULTI-POLE MAGNET ROLLER)

Figure 5:
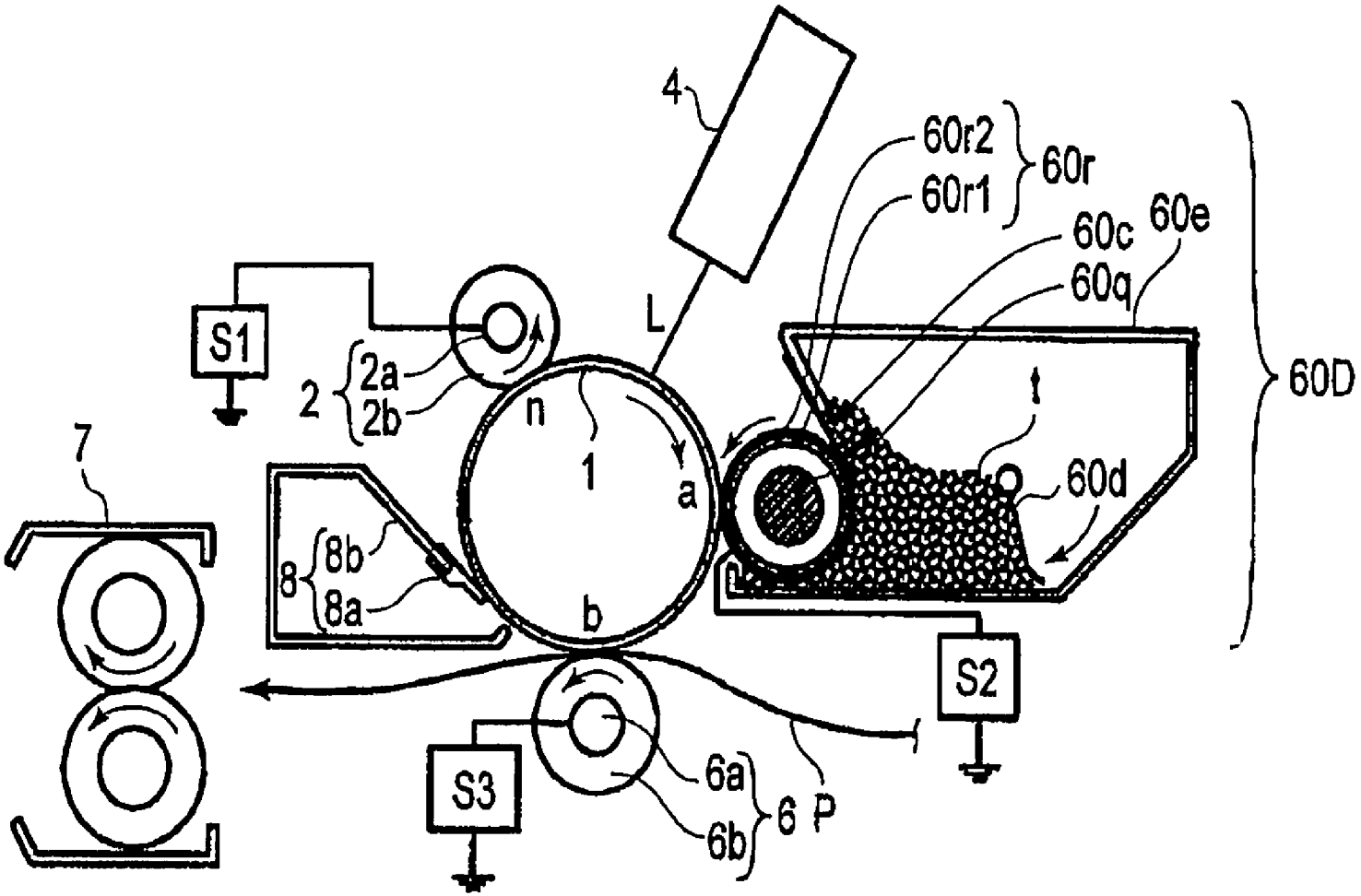
FIG. 5 is a schematic drawing of a developing apparatus of scheme 1 of a fourth comparison example, showing the general structure thereof.

The developing device 60D of comparison example 4 will be described. FIG. 5 is a schematic view of an image recording device using the developing device of comparison example 4 of scheme 1.

Designated by 60*r* is a developing sleeve as a developer carrying and feeding member enclosing a magnet roller 60*q*. The developing sleeve 60*r* comprises an aluminum cylinder 60*r*1 and a non-magnetic electroconductive elastic layer 60*r*2 and is contacted to the photosensitive drum 1 with a predetermined pressure. The pressure is 200 N/m in the drawing pressure. The electroconductive elastic layer 60*r*2 produced by kneading materials, and extruding the kneaded material. It is bounded on the aluminum sleeve 60*r*1 with the thickness of 500 μm and is then abraded, thus providing the developing sleeve 60*r*1 . The microhardness thereof is 94°, and surface roughness Ra thereof is 1.2 μm.

The magnet roller 60*q* is a multi-pole magnet roller having 8 poles at regular intervals. The peak densities of the magnetic flux densities provided are 300 G (absolute value).

The magnet roller 60*q* is rotated in the direction opposite the rotational direction of the developing sleeve 60*r* in the same rotational speeds.

The toner t4 is carried on the developing sleeve 60*r* while being subjected to the magnetic force provided by the magnet roller 60*p*, during which a layer thickness of the toner t4 is regulated by the regulating blade 60*c*, and the toner t4 is triboelectrically charged. Designated by 60*d* is a stirring member for circulating the toner in the developing container 60*e* and feeding the toner sequentially into magnetic force reaching ranges around the surface of the sleeve.

The developing device 60D of in this embodiment employs a regulating blade 60*c* which has a length of a free part of 1.2 mm and which is placed with a drawing pressure of 30 N/m.

The toner t applied on the developing sleeve 60*r* is carried by the rotation of the sleeve 60*r* to the developing zone (developing zone portion) where the sleeve 60*r* opposed to the surface of the photosensitive drum 1. The sleeve 60*r* is supplied with a developing bias voltage DC voltage of −450V) from the developing bias applying voltage source S2. The developing sleeve 60*r* is rotated at a peripheral speed which is 1.2 times the peripheral speed of the photosensitive drum 1. By doing so, the electrostatic latent image on the photosensitive drum 1 is developed with the toner t1 (reverse development).

Toner t4 is the same as with comparison example 1.

Japanese Patent Application Publication Hei 4-15949 discloses a developing device which is similar to the structure of this comparison example.

DEVELOPING DEVICE OF COMPARISON EXAMPLE 5 (PROXIMITY AC WITH ELASTIC SLEEVE)

The developing device of comparison example 5 is different from the developing device 60A of Embodiment 1.

The photosensitive drum 1 and the developing sleeve 60*b* are placed with the gap of 200 μm therebetween, and the supplied developing bias comprises a DC voltage −450V and an AC voltage (rectangular wave, 800 Vpp, 2000 Hz) (proximity AC). The regulating blade 60*c* is set with a drawing pressure of 30 N/m, and the free part length thereof is 0.5 mm.

Japanese Laid-open Patent Application Hei 7-28335 discloses a developing device which it similar to the structure of the developing device of this example.

DEVELOPING DEVICE OF COMPARISON EXAMPLE 6 (NON-MAGNETIC CONTACT DEVELOPMENT)

A developing device 60E of comparison example 6 will be described. FIG. 5 is a schematic view of an image recording device using the developing device of comparison example 4 of scheme 1.

Designated by 60*h* is a developing roller comprising the core metal 60*h*1 and an electroconductive elastic layer 60*h*2 thereon. Designated by 60*k* is an elastic roller comprising a core metal 60*k*1 and an elastic layer 60*k*2 thereon. The developing roller 60*h* is contacted into the photosensitive drum 1 with up to determine depression corresponding to a drawing pressure of 20 N/m. The elastic roller 60*k* is fixed with a predetermined distance between the shafts of the developing roller 60*h* and the elastic roller 60*k*, and the drawing pressure there between is 40 N/m.

The developing roller 60*h* is rotated to provide a peripheral speed which is 1.4 times the peripheral speed of the photosensitive drum 1, and the elastic roller 60*k* is driven to rotate in the opposite peripheral direction document to the developing roller at the same rotational speed. The rubber hardness of the developing roller 60*h* is 50° in ASKER-C hardness (500 g) and is 42° in microhardness.

The stirring member 60*d* functions to supply the toner t5 to the elastic roller 60*k*. Furthermore, the elastic roller 60*k* functions to supply the toner t5 to the developing roller 60*h* by the rotation thereof. The toner supplied to the surface of the developing roller 60*h* is regulated into a predetermined layer thickness and is triboelectrically charged by the regulating blade 60*i*, and the toner layer is fed to the developing zone. The toner fed to the developing roller is used for developing the latent image on the photosensitive drum at the developing zone a. The toner not consumed for the development and remaining on the developing roller 60*h* is scraped off by the elastic roller 60*k*, and is recirculated in the container 60*e* and is again applied on the surface of the developing roller 60*h*.

The applied developing bias comprises a DC voltage of −450V which is applied to the developing roller core metal 60*h*1. The elastic roller 60*k* and the regulating blade 60*i* are also supplied with the same developing bias.

The used toner t5 is one component magnetic toner t5 and is produced by mixing and kneading binder resin, magnetic particle and charge control material through a pulverization and classification. It contains externally added material for fluidization and charging particles m. The average particle size (D4) of the toner is 8 μm.

DEVELOPING DEVICE OF COMPARISON EXAMPLE 7 (NON-CONTACT FEEDING ROLLER)

Figure 7:
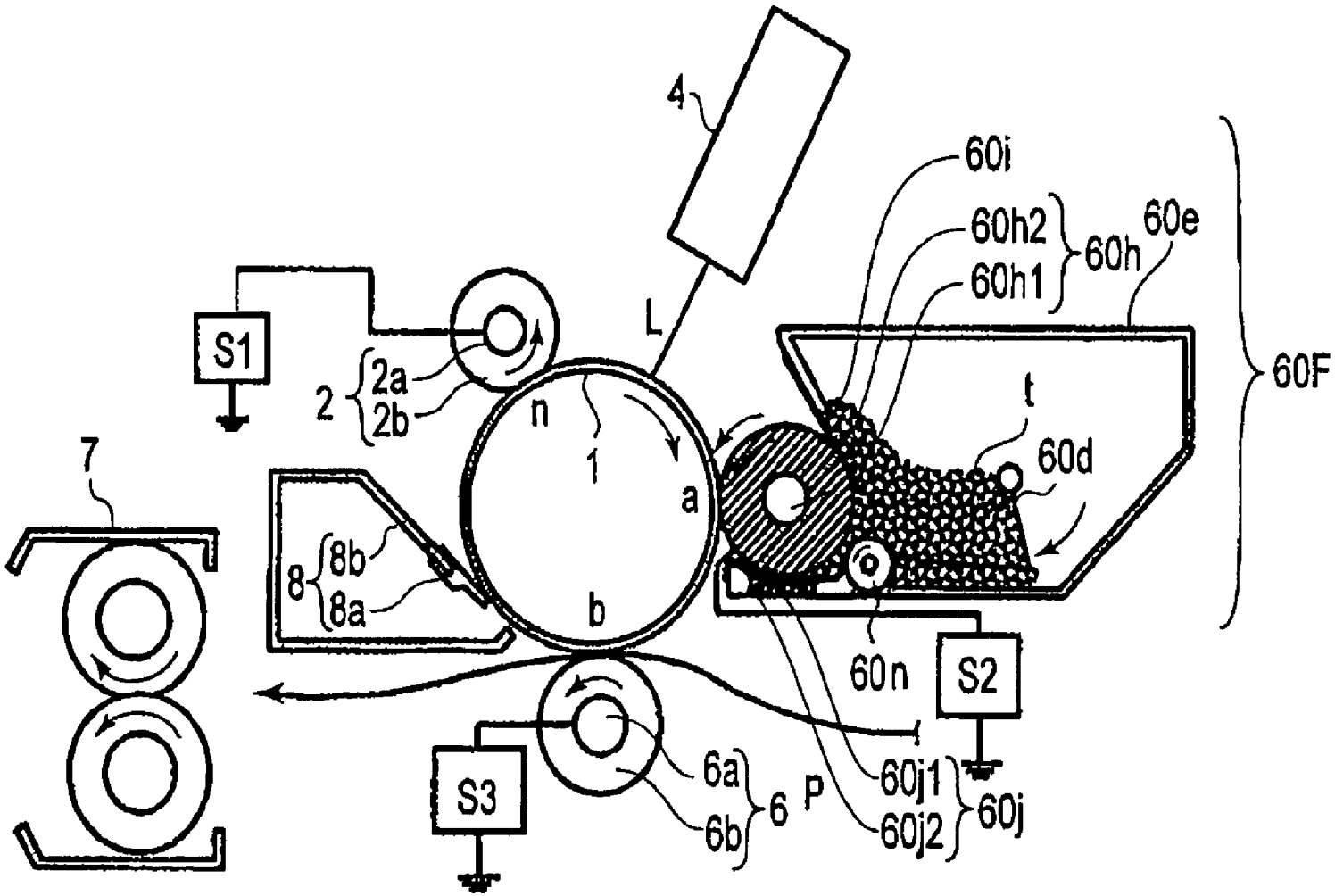
FIG. 7 is a schematic drawing of a developing apparatus of scheme 1 of a seventh comparison example, showing the general structure thereof.

The developing device 60F of comparison example 7 will be described. FIG. 7 is a schematic view of an image recording device using the developing device of comparison example 7 of scheme 1.

Designated by 60*h* is a developing roller comprising the core metal 60*h*1 and an electroconductive elastic layer 60*h*2 thereon. Designated by 60*j* is a discharging sheet including an electroconductive sheet 60*j*2 which is lined with an elastic member 60*j*1. The developing roller 60*h* is contacted into the photosensitive drum 1 with up to determine depression corresponding to a drawing pressure of 20 N/m. The discharging sheet 60*j* urged to the developing roller 60*h* with a predetermined pressure so that the drawing pressure is 55 N/m. The developing roller 60*h* is rotated to provide a peripheral speed which is 1.4 times the peripheral speed of the photosensitive drum 1. In addition, a feeding roller 60*n* is disposed to the developing roller without contact thereto and is rotated to provide the same peripheral speed as the developing roller 60*h*. The rubber hardness of the developing roller 60*h* is 50° in ASKER-C hardness (500 g) and is 42° in microhardness.

The stirring member 60*d* functions to supply the toner t5 to the feeding roller 60*n*. The feeding roller 60*n* functions to supply the toner t5 to the developing roller 60*h* by the rotation thereof. The toner supplied to the surface of the developing roller 60*h* is regulated into a predetermined layer thickness and is triboelectrically charged by the regulating blade 60*i*, and the toner layer is fed to the developing zone. The toner fed to the developing roller is used for developing the latent image on the photosensitive drum 1 at the developing zone a. The toner not consumed by the development and remaining on the developing roller 60*h* is electrically discharged by the discharging sheet 60*j*, and then is recirculated in the container 60*e* and is again applied on the developing roller 60*h*.

The applied developing bias comprises a DC voltage of −450V which is applied to the developing roller core metal 60*h*1. The feeding roller 60*n* and the regulating blade 60*i* are supplied with the same developing bias potential.

Toner t5 is the same as with comparison example 1.

Japanese Patent No. 3225759 discloses a developing device of a structure similar to this example.

Developing Device of Embodiment 5

The developing apparatus of this Embodiment 5 is different from the developing device 60A of the Embodiment 1 in the developing bias applying voltage source S2. The developing bias applying voltage source S2 of this embodiment applies the developing bias voltage of DC voltage −450V superimposed with an AC voltage in the form of a rectangular wave having a frequency of 1.2 kHz and a peak-to-peak voltage of 300 V.

Developing Device of Embodiment 6

The developing apparatus of this Embodiment 6 is different from the developing device of the Embodiment 3 in the developing bias applying voltage source S2. The developing bias applying voltage source S2 of this embodiment applies the developing bias voltage of DC voltage −450 V superimposed with an AC voltage in the form of a rectangular wave having a frequency of 1.2 kHz and a peak-to-peak voltage of 300 V.

Measurement of Amount and Specific Charge (Amount of Electric Charge) of Coating of Toner:

In the present invention, the specific charge of the toner and the amount of the toner coating on the developing sleeve after the toner is regulated by the developing blade, is measured in the following manner.

Figure 8:
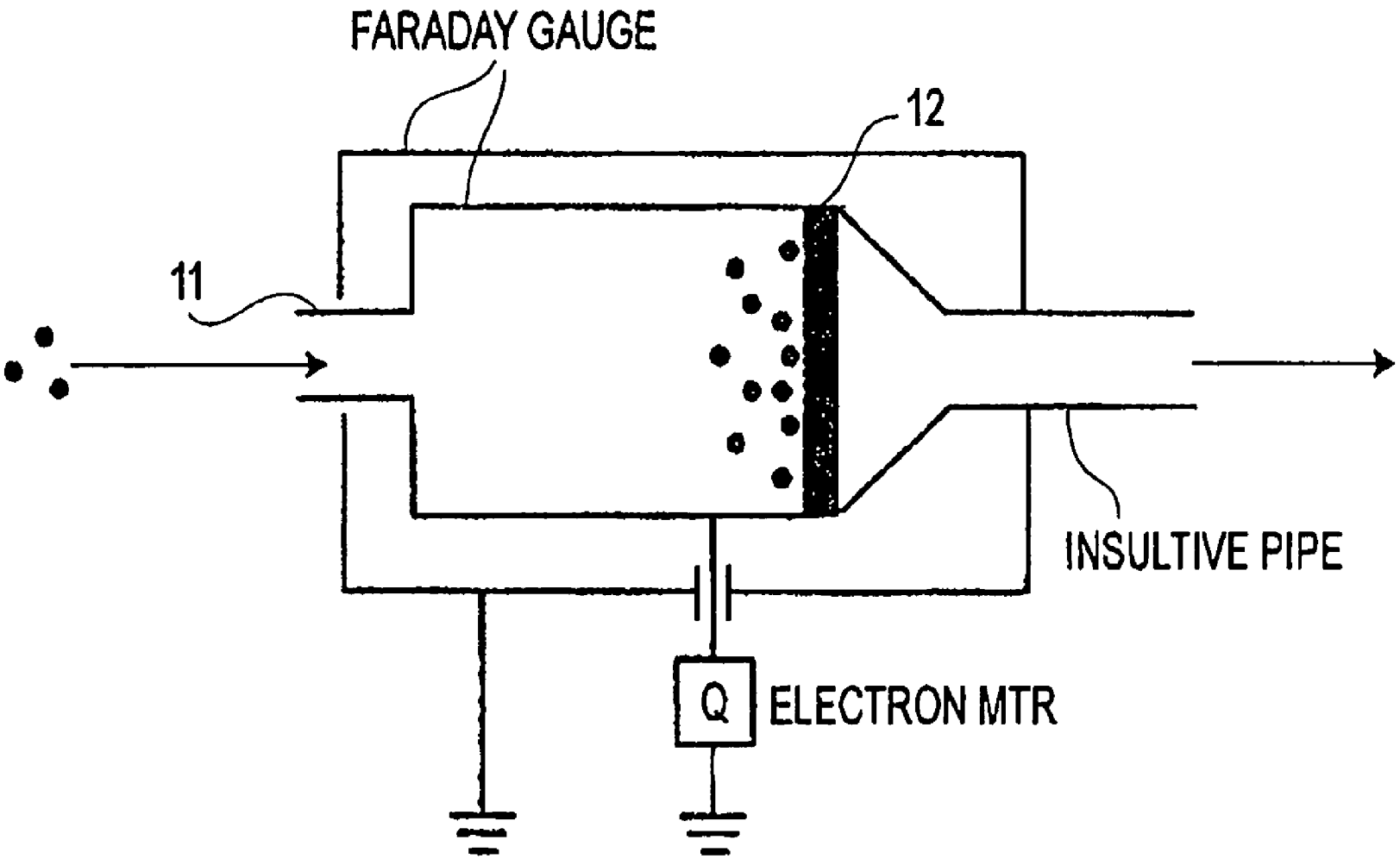
FIG. 8 is a schematic drawing of a measuring apparatus of a suction type based on Faraday's law.

The amount of electric charge of the developer coating the developing roller or the developing sleeve is measured by so-called suction type Faraday gauge method. FIG. 8 shows an apparatus used in the measurement through the suction type Faraday gauge method, wherein the suction opening 11 is abutted to the developing sleeve or developing roller, and the developer is sucked to collect the toner on a filter 12 provided in an inner cylinder. At this time, the inner cylinder is electrostatically shielded from outside, and the amount Q (C) of electric charge of the developer accumulated here is measured by an electrometer 6517A, available from KEITHLEY Corp. The weight M (g) of the sucked developer is calculated on the basis of the increase of the weight of the filter, and the area S (m2) from which the toner is sucked is measured, too. Then, the specific charge of the developer on the sleeve Q/M (μC/g) and the amount of coating M/S ($g/m^2$) are calculated. For the measurement, an operation of the main assembly of the recording device is stopped during operation of solid white printing, and the measurement is carried out for the developing roller or developing sleeve.

Advantaged of the Embodiments Over Prior Art

Evaluation method for Embodiments 1-5 and comparison examples 1-7 will first be described.

An image evaluation for embodiment 1-5 and comparison example 1-7 will be described.

I. Image evaluations for the image recording device (FIG. 1 using drum cleaner 8) in Embodiment 1 of scheme 1:

a) Evaluation of fog prevention:

The fog means an image defect of background contamination caused by a small amount of toner deposited on a white portion (un-exposed portion) where the toner is not supposed to deposit by development.

The amount of fog is measured in this manner. The optical reflectance of the white portion is measured by an optical reflectance measuring machine TC-6DS available from Tokyo Denshoku using a green filter, and the difference of the measurement from the reflectance obtained when a plane paper is measured, is used as the reflectance of the fog. In determination of the amount of the fog, the measurements are carried out at least 10 different points on the recording paper, and the average of the measurements is employed as the amount of the fog.

N: the amount of fog exceeds 2%.

F: the amount of fog is 1-2%.

G: the amount of fog is 0.5-1%.

E: the amount of fog is less than 0.5%.

The fog prevention evaluation is carried out for the initial 100 sheets, and after 2000 sheets printing. In the printing test, an image of lateral lines of image ratio of 5% is repeatedly continuously printed. If an image defect other than the defects which will be describe hereinafter occurs, the defect portion is excluded from the measurement to evaluate the fog only.

b) Fog property evaluation when the remaining toner amount is short:

With repetition of the printing test, the amount of the toner in the developing device decreases, therefore, the image density of the lateral lines decreases, and in an extreme case, the lateral lines partly disapear. The fog prevention performance when the remaining toner amount decreases, the evaluation is made separately. When the effects of the lateral line images appear during the printing test, the fog prevention evaluation is carried out, and thereafter, the developing device is removed from the recording device, and then, the developing device is manually shaken to force the toner to move to the developing sleeve and the developing roller. The developing device is then mounted into the apparatus, and the fog prevention evaluation is carried out. The fog prevention evaluation of them are made in the manner similar to that described above. The worst result is selected and is used for the fog prevention evaluation.

c) Ghost image:

The supply and removal performance of the developer is evaluated on the basis of development ghost. For this evaluation, the checking is made with ghost images appearing at intervals corresponding to the period of the rotation of the developing roller or the developing sleeve in consideration of the peripheral speeds of the developing roller and the developing sleeve and the process speed. The occurrence of the ghost image is discriminated in this manner. Solid black patch images of 5 mm square and 25 mm square are printed at the leading end of the sheet, and then, a halftone image is formed immediately after that. When the density difference between the halftone image portion and the previous solid black portion is recognized by visual observation, it is discriminated that ghost image occurs. The scanner machine used in the tests is a 600 dpi laser scanner. In the tests, the halftone image is represented by an image comprising 1 line extending in the main scan direction and subsequent non-printed 4 lines. The image thus provided, as a total, represents a half-tone image.

The image evaluation is made as follows:

N: the ghost images of both of the patches are recognized:

F: the ghost image of only one of the patches is recognized:

G: none of the ghost images of the patches is recognized:

The evaluations are carried out for initial 100 sheets.

d) Hair line uniformity:

The image evaluation for this purpose is carried out on the basis of continuity of 1 dot line in the longitudinal and lateral directions. The scanner machine used in the tests is a 600 dpi laser scanner. 1 dot line extending parallel to the process advancing direction and 1 dot line extending parallel to the main scan direction of the laser scanning system, and the variations are carried out for both of them. Such hair line image having a length of 2 cm is printed in each of the examples, and 100 lines are selected at random. An area of 200 μm square with one line at the center thereof, for each of the 100 points, is observed by an optical microscope. For each of the lines, a half-peak width of the density of the line is determined as the line width of the line. A standard deviation of the line widths is calculated for each direction. A line standard deviation ratio $\sigma v/\sigma h$ is obtained from the calculated line standard deviation $\sigma v$ for the process direction, and the calculated laser scanning direction standard deviation $\sigma h$. Using the value thus obtained, the following evaluation is carried out:

N: the line standard deviation ratio $\sigma v/\sigma h$ is less than 0.7 or more than 1.43:

F: the line standard deviation ratio $\sigma v/\sigma h$ is not less than 0.7 and less than 0.8, or not less than 1.25 and not more than 1.43:

G: the line standard deviation ratio $\sigma v/\sigma h$ is not less than 0.8 and less than 1.25.

The evaluations are carried out for initial 100 sheets.

e) Image edge defect:

For this image evaluation, an image including a solid black image of 25 mm square in a solid white background is printed. Transmission densities at the edge portion of the solid black image are measured using a transmission densitometer Model 310T, available from X-Rite Corp. With the aperture size of 1.0 mm. The measurement is carried out at 10 points at each of the edge portion and the central portion of the solid black, and the difference in the density between them is calculated.

N: the density difference is not less than 0.1:

G: the density difference is less than 0.1:

The evaluations are carried out for initial 100 sheets.

f) Solid white image defect:

This image evaluation is made on the basis of an image defect occurring at the interval equal to the cyclic period of the developing sleeve or developing roller. The cyclic period of development is accurately calculated in consideration of the process speed and the peripheral speed ratio between the photosensitive drum and the developing sleeve. Then, the image defect appearing at the cyclic period is extracted, and is checked. The size of the image defect is approximately 2-3 mm in width and 3-10 mm in length, the partial optical density is approximately 0.3 to 1, and such image defects are separately checked. The evaluation can be clearly made on the basis of presence or absence of such a defect: The evaluation is made as follows:

N: there is an image defect:

G: there is not image defect:

For this evaluation, 10 solid white images are continuously printed.

g) Toner scattering:

For the purpose of this evaluation, after 2000 sheets test printing operations, the toner deposited on the outer wall of the cartridge or on the inside of the main assembly is collected, and the weight thereof is measured.

N: the amount of the scattered toner exceeds 0.5 g:

F: the amount of the scattered toner is 0.1-0.5 g:

G: the amount of the scattered toner is not more than 0.1 g:

The evaluations are carried out for initial 100 sheets.

h) Halftone image defect:

Of the purpose of this image evaluation, image evaluation an are printed, and the evaluation is made on the basis of the number of the image defects. The scanner machine used in the tests is a 600 dpi laser scanner. In the tests, the halftone image is represented by an image comprising 1 line extending in the main scan direction and subsequent non-printed 4 lines. The image thus provided, as a total, represents a half-tone image.

In this invention, a particular attention it paid to the uniformity of the halftone image, and defect of white dot or black dot having a size of not less than 0.3 mm is checked.

G: the number of white dot or black point in the halftone image is larger than 5:

F: the number of white dot or black point in the halftone image is 1-5:

G: the number of white dot or black point in the halftone image is 0:

The evaluation is made for the prints after 2000 sheets text printing.

II. Image recording device of scheme 2 (m FIG. 2 not using a drum cleaner).

The description will be made as to the image evaluations for the images followed by the apparatus of scheme 2 (FIG. 2) not using the drum cleaner 8 (FIG. 1).

A) Toner collection property by developing device of cleanerless type:

For this evaluation, a solid black image of 30-50 mm is printed at the leading end of the printed image area, and thereafter the image recording device is operated to print an evaluation pattern having a solid white image and is stopped during the printing operation. The timing of the stop is the instance when the center position of the solid black image at the leading end comes to the developing zone. The reflectance of the toner deposited on the surface of the photosensitive drum is measured at each of the points before and after development. The toner collection efficiency can be evaluated on the basis of a ratio between the reflectances. Actually, the toner on the drum is transferred on a transparent tape, which in turn is stuck on a plain paper, and the net reflectance of the toner is measured in the same manner as with the fog measurement.

N: the collection rate is less than 30%:

F: the collection rate is less than 50%:

G: the collection rate is not less than 50%:

The evaluations are carried out for initial 100 sheets.

B) halftone image defect (scheme 2).

The halftone image defect evaluation is carried out for the scheme 2 similarly to the scheme 1.

C) Halftone image defect attributable to paper dust:

In the apparatus of scheme 2, the paper dust (paper fibers) may be deposited on the photosensitive drum, and may enter the developing device after it is subjected to charging. If it is taken in the developing device, the paper dust may be engaged with the elastic roller, and may produce an image defect extending in the direction of advancement of the process operation at the intervals which are the same as the cyclic period of the elastic roller. Such defects are checked separately from the halftone image defect.

The image defect having a width of not less than 0.3 mm and a length of not less than 2 mm is recognized as the defect, and the number of such defects is counted.

G: the number of the defects in the halftone image exceeds 5:

F: the number of the defects is 1-5:

G: the number of the defects is 0:

D) Solid black image defect:

For this image evaluation, a solid black image is printed, and the evaluation is made on the basis of the number of defects in the images. Here, the defect of a size not less than 0.3 mm is considered as a defect.

N: the number of white dots having a diameter of not less than 0.3 mm in the solid black image is larger than 50:

F: the number of white dots having a diameter of not less than 0.3 mm in the solid black image is larger than 10-50:

G: the number of white dots having a diameter of not less than 0.3 mm in the solid black image is less than 10:

The ambient conditions are 32.5° C., 80% Rh. For the evaluation, three solid black image are printed after 24 hours elapse after 1000 sheets print. The defect is represented by one one the three prints that involves most defects.

Table 1 show the results of evaluations of the developing devices according to Embodiments 1-6, and the developing devices of comparison examples 1-7. The advantageous effects corresponding to the evaluation items will be described hereinafter.

TABLE 1

| | Scheme 1 | | | | | | | | | | | | Scheme 2 | | | |
|---|---|---|---|---|---|---|---|---|---|---|---|---|---|---|---|---|
| | *1 | *2 | *3 | *4 | *5 | *6 | *7 | *8 | *9 | *10 | *11 | *12 | *13 | *14 | *15 | *16 |
| Emb. 1 *A | 0.976 | 0.001 | 29 | 10 | G—G | G | G | G | G | G | G | G | G | G | G | G |
| Emb. 2 *B | 0.968 | 0.01 | 32 | 9 | G—G | G | G | G | G | G | G | G | G | G | G | G |
| Emb. 3 *C | 0.950 | 0.01 | 16 | 14 | G—G | G | G | G | G | G | G | G | G | G | G | G |
| Emb. 4 *D | 0.945 | 0.05 | 16 | 14 | G—G | G | G | G | G | G | F | G | G | G | G | G |
| Comp. Ex. 1 *E | 0.945 | 0.05 | 6 | 10 | G—G | G | G | N | N | G | G | G | N | G | G | N |
| Comp. Ex. 2 *F | 0.945 | 0.05 | 6 | 10 | F—F | — | G | G | N | G | N | G | N | G | G | N |
| Comp. Ex. 3 *G | 0.945 | 0.05 | 6 | 10 | N Initial | — | G | N | G | N | G | G | F | G | G | G |
| Comp. Ex. 4 *H | 0.945 | 0.05 | 7 | 10 | G—F | F | F | N | G | G | G | G | F | G | N | G |
| Comp. Ex. 5 *I | 0.945 | 0.05 | 7 | 10 | G—G | G | G | N | N | G | G | G | N | G | G | F |
| Comp. Ex. 6 *J | 0.945 | — | 40 | 4 | E—F | N | G | G | G | G | G | F | G | N | N | G |
| Comp. Ex. 7 *K | 0.945 | — | 30 | 4 | G—F | F | F | G | G | G | G | G | G | F | N | G |
| Emb. 5 | 0.976 | 0.001 | 20 | 11 | G—G | G | G | G | G | G | G | G | G | G | G | G |
| Emb. 6 | 0.950 | 0.01 | 16 | 14 | G—G | G | G | G | G | G | G | G | G | G | G | G |

*1 Ave. Circurality
*2 B/A
*3 Q/M
*4 M/S
*5 a) Fog (100–2000 prints)
*6 b) Fog (when toner is short)
*7 c) Ghost
*8 d) Hair line uniformity
*9 e) Image edge defect
*10 f) Defect in solid white
*11 g) Toner scattering
*12 h) Defect in halftone image
*13 A) Toner collection (cleanerless)
*14 B) Defect in halftone image (Emb. 2)
*15 C) Defect in halftone image by paper dust
*16 D) Defect in solid black image
*A Contact DC/Elastic Sleeve/High Sphericality/Low Surface Iron
*B Contact DC/Elastic Sleeve/High Sphericality/High Surface Iron
*C Contact DC/Elastic Sleeve/Low Sphericality/High Surface Iron
*D Contact DC/Elastic Sleeve/Low Sphericality/High Surface Iron/Mag. Regl.
*E Non-contact DC
*F Non-contact DC/Mag. Regl.
*G Contact DC/Rigid Sleeve
*H Multi-pole Mag.
*I Proximity DC/Elastic Sleeve
*J Non-magnetic toner
*K Non-magnetic toner/Discharging Sheet 1) the description will be made as to the advantages of this embodiment over the comparison examples which corresponds to a conventional non-contact type developing type system or a conventional non-magnetic contact developing type system.

2) in developing device 60B of comparison example 1 of scheme 1 (FIG. 3, magnetic non-contact type developing system), a deterioration of hair line uniformity or image edge defect appear. Since the development is effected by magnetic chains formed by the magnetic field in comparison example 1, the hair line uniformity tends to be different depending on the moving direction of the chains. In addition, the distance between the sleeve and the drum is relatively large, and the toner jumps at the positions irrespective of where the position is an image portion or non-image portion, with the result that toner is concentrated at the edge portion, and therefore, that there is produced a density difference between the edge portion and the central portion.

In the case of cleanerless type in scheme 2, it will be understood that toner collection property remarkably deteriorates. Also, a solid black image defect appears. Under the normal conditions, no leakage of the developing bias occurs, but the leakage occurs under a high temperature and high humidity ambience, and it occurs also when foreign matter such as paper dust exist between the developing sleeve and the drum since the foreign matter may provide an electrical path.

Figure 6:
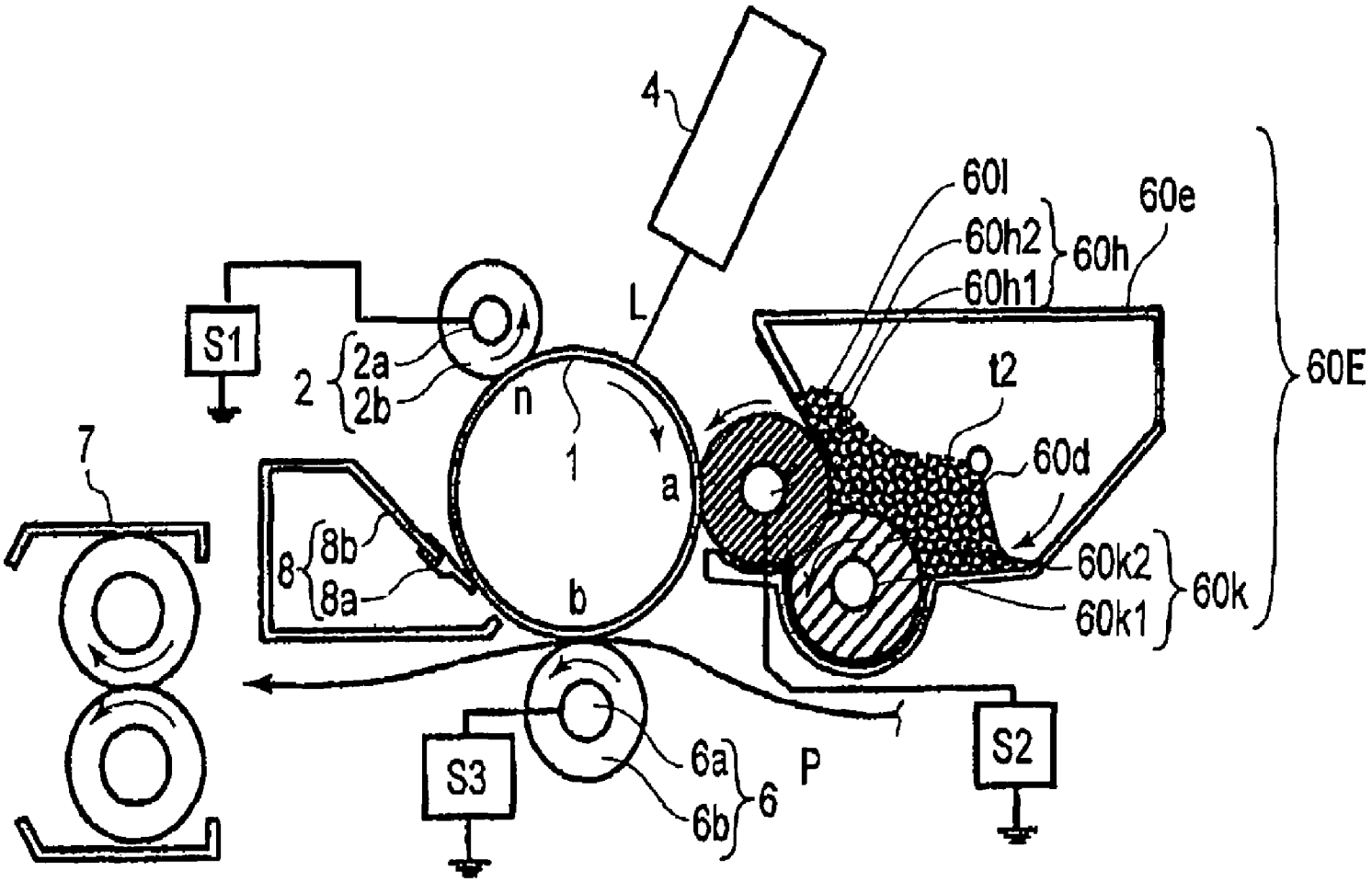
FIG. 6 is a schematic drawing of a developing apparatus of scheme 1 of a sixth comparative example, showing the general structure thereof.

3) as for the developing device 60E of comparison example 6 of scheme 1 (FIG. 6, non-magnetic contact developing system), the fog prevention performance deteriorates in a long term use. This is because the toner is subjected to a mechanical stress due to the supplying and peeling action of the elastic roller 60*k*, with the result of deterioration of the toner charging property. Also, the density reduction appears. When the amount of the toner in the developing device decreases, the deteriorated toner and undeteriorated toner not included in the circulation, are mixed, so that toner charging property is remarkably deteriorated, and therefore, high density fog results.

In the case of cleanerless type in scheme 2, the collection property is satisfactory, but a halftone image defect which is understood as being attributable to the elastic roller is remarkable. Also in scheme 2, in addition to the mechanical stress by the elastic roller, the deterioration of the toner is caused by the toner returning into the developing device after being subjected to the development action, the transfer action and the charging action. The problem arising from the paper dust mixed into the developing device is also remarkable, and it is deposited on the surface of the elastic roller with the result of periodical image defects.

4) on the other hand, the developing devices 60A (FIGS. 1 and 2) of Embodiments 1-3 provide a satisfactory image formation, irrespective of whether it is a scheme 1 type or scheme 2 type or not.

The evaluation of the scheme i type device of FIG. 1 will be described. The hair line uniformity which is a problem with comparison example 1 (FIG. 3), is good in both directions. The magnetic force in the developing zone is the same, and the formed magnetic field is the same, but the influence of the magnetic chains during the development is effectively eliminated since the amount of the toner and the amount of electric charge of the toner on the elastic sleeve are kept at a proper level, and since formation of long magnetic chains is suppressed by the application of the DC bias voltage. In addition, there is not image edge defect, and therefore, uniform image reproduction is accomplished. This is because the elastic sleeve is contacted to the photosensitive drum with the application of a DC voltage, and therefore, the concentration of the toner during the reciprocations of the toner is prevented.

The deterioration in the fog prevention performance in long term use, which is a problem in comparison example 6 (FIG. 6), is not observed. The elastic roller 60*k* used in comparison example 6 is not used in this embodiment. The toner is fed by means of the magnetic force. In comparison example 6, where the toner is fed by the elastic roller, there is a locally high pressure.

In Embodiments 1-3, on the other hand, the toner is fed by the magnetic force, so that toner is removed from and supplied to the developing sleeve under a small mechanical stress. As contrasted to the case of the elastic roller, the force is supplied without contact, and therefore, the size of the toner circulation range and the toner circulation efficiency are better than those in the comparison example. Thus, the toner can be removed and supplied with less stress imparted to the toner, so that toner feeding is possible without the problem of ghost image. For the same reason, toner agglomeration is not produced.

5) the evaluation of embodiment 1-3 of scheme 2 (FIG. 2) will be described.

Since the elastic sleeve is disposed contacted to the photosensitive drum, the working area and the intensity of the electric field and/or magnetic field increases by the reduction of the distance between the elastic sleeve and the photosensitive drum. By this, the toner collection property from the residual toner deposited on the un-exposed portion of the surface of the image bearing member is improved. In addition, the halftone image defect and the influence of the paper dust are at a satisfactory level, because the toner operation does not rely on an elastic roller but on a magnetic force. Furthermore, no solid black image defect which appears in comparison example 1 is not observed. This is because although a large electric field is applied, the potential difference is not so large as to generate discharge.

6) the advantage effects of the use of the magnetic force in the embodiments of the present invention, including comparison example 2 (FIG. 3) and Embodiment 4 (FIG. 4).

In comparison example 2, the magnetic pole in the developing zone is omitted in a non-contact AC development. For this reason, the hair line uniformity is improved, but the fog is worse. In addition, the toner scatters. The developing pole in the non-contact AC type developing device of comparison example 1, is effective to attract the toner toward the developing device side to prevent the fog due to the movement of the toner having the opposite polarity or having low charge to the photosensitive member. This is also effective to prevent the toner scattering However, the hair line uniformity is deteriorated since the magnetic chain is formed. They are contradictory to each other.

On the other hand, in Embodiment 4, the magnetic pole is not used at the developing zone, similarly to comparison example 2, but the fog prevention performance is kept good. That is, according to the present invention, the toner coating amount and the specific charge of the toner are maintained at a proper level, so that production of the toner of the opposite polarity or the toner having a low charge level is prevented, and therefore, the fog is not produced without use of the magnetic force. In addition, the formation of the magnetic chain is suppressed, and therefore, the hair line uniformity is maintained irrespective of presence or absence of the magnetic field.

The developing device 60A of the embodiments effectively uses, regarding the supply of the toner, the magnetic force to accomplish toner removal and supply under a low stress condition, and simultaneously, uses, regarding the development, an electrostatic without relying on the magnetic force, and therefore, the developing device does not produce the fog or the problem attributable to the magnetic chain. As regards the toner scattering, Embodiments 1-3 are slightly advantages.

7) comparison with the comparison examples other than comparison examples 1 and 6:

The device of comparison example 3 is a modification of comparison example 1 in that contact development is used and in that DC bias voltage is used. However, the developing sleeve does not have a surface elastic layer, and in addition, the property of the coated toner is not within a proper range. For these reasons, a solid white image defect and fog are very remarkably produced from the initial stage of printing, and the hair line uniformity is not good because many magnetic chains are formed. The cleanerless collection property is locally and slightly good, but the solid white image defect and the fog are remarkable, and therefore, the developing device of this example is not suitable to a cleanerless apparatus.

On the other hand, the device of comparison example 5 used a surface elastic layer on the sleeve, but it is of a non-contact type, and therefore, the advantage effects of Embodiment 1 are not provided even if the surface of the sleeve is made closer to the image bearing member than in comparison example 1. Since the magnetic chain is formed, the hair line uniformity is not high, and the image edge defect is still no good even when they are made closer. In the cleanerless collection property is still unsatisfactory. The image defect in the solid black is slightly improved, but there still are many white dots.

It would be considered that, as in comparison example 4 (FIG. 5), the use is made with a multi-pole magnet roller 60*q* in an attempt to improve the supply or removal property using a rotational magnetic force. However, the results are deterioration of the ghost image preventing property. In addition, the magnetic force oscillates in the regulating portion and in the developing zone, and therefore, the fog preventing performance is not good. The use of the multi-pole magnet is effective to slightly reduce the magnetic force, but the influence of the magnetic chains still remains with the result of poor hair line uniformity. On the other hand, since the contact DC development type is employed, the image edge defect and the collection property are improved because of the contact to the photosensitive member.

Comparison example 7 (FIG. 7) is a modification of comparison example 6 (FIG. 6) and is different in the removing and supplying member in an attempt to provide both of satisfactory fog prevention and ghost image prevention. However, the results are not enough, although the fog prevention is slightly improved. Since the peeling member is fixed, the halftone image defect in scheme 2 of FIG. 2 and the halftone image defect are remarkable. Since the fixed peeling member is used, the defect is not periodical, but the defects in the form of stripes are observed. The developing device has been disassembled after the printing operation, and it has been found that there are deposited matter of paper dust and the like on the peeling member. The reason why the halftone image defect is remarkable in the cleanerless type (scheme 2) than in the type (scheme 1) using the cleaner, would be that deterioration of the toner is promoted by the collected toner, or agglomeration of the toner is promoted around the foreign matter contained in the collected toner, with the result of production of the agglomerated toner.

8) Embodiments 5 and 6 will be described.

Embodiment 5 is a modification of Embodiment 1 and is defined from Embodiment 1 in that AC bias voltage is superimposed, and Embodiment 6 is a modification of Embodiment 3 and is different from Embodiment 3 in that AC bias voltage is superimposed. The fog preventing performance is slightly improved over Embodiment 1, Embodiment 3, respectively. The fog deposition on the drum after the development is clearly improved, and therefore, a certain degree of AC bias application reduces the fog. When the AC component is contained, even the developing sleeve involving a defect such as deposition of the foreign matter is no problem since the defective portion does not appear on the image, and therefore, a wider margin is provided for the reproduction of the half-tone images. In addition, in scheme 2 type, the collection rate is higher when the AC voltage component is applied than when it is not applied.

Ranges of specific charge (amount of electric charge) and toner coating amount when average circularity is not less than 0.965:

The description will be made as to the developer amount and specific charge of the toner per unit area when the average circularity of the toner is not less than 0.965.

1) Embodiments 7, 8, 9, 10, 11, 12, 13 and 14.

The developing devices of Embodiments 7-14 are fundamentally the same as the developing device 60A of Embodiment 1, but are different in the following points:

As regards the setting of the regulating blade, the drawing pressures are as follows:

35, 65, 55, 55, 65, 65, 65 and 65 N/m, respectively.

The free part lengths of the blades are as follows:

2.5, 1.0, 3.0, 2.5, 1.5, 3.0, 1.0 and 0.5 mm, respectively.

The surface roughnesses of the developing sleeve surface Rz are as follows:

2.7, 5.0, 3.8, 3.8, 4.5, 4.5, 4.5 and 5.0, respectively.

The surface roughness of the developing sleeve surface Ra are as follows:

0.4, 0.8, 0.6, 0.6, 0.7, 0.7, 0.7 and 0.8, respectively.

2) Comparison examples 8, 9, 10, 11, 12, 13 and 14.

The developing devices of comparison examples 8-14 are fundamentally the same as the developing device 60A of Embodiment 1, but are different in the following points:

As regards the setting of the regulating blade, the drawing pressures are as follows:

45, 45, 55, 65, 55, 65 and 55, respectively.

The free part lengths of the blades are as follows:

3.5, 1.5, 3.5, 1.0, 3.0, 0.5 and 0.5 mm, respectively.

The surface roughnesses of the developing sleeve surface Rz are as follows:

2.7, 2.7, 3.8, 3.8, 4.5, 5.0 and 2.7, respectively.

The surface roughnesses of the developing sleeve surface Rz are as follows:

0.4, 0.4, 0.6, 0.6, 0.7, 0.8 and 0.4, respectively.

3) evaluation method for the embodiments and the comparison examples:

In scheme 1 type, the image evaluations are made with respect to the a) fog prevention evaluation, b) fog property evaluation when the remaining toner amount is short, c) development ghost, d) hair line uniformity and f) solid white image defect.

The following image evaluation items are added.

i) solid black density:

In scheme 1, a solid black image is printed on the whole surface of the sheet, and the optical reflection density thereof is measured by a densitometer RD-1255 available from Macbeth Corp. The evaluation is as follows:

N: the density is less than 1.2:

F: the density is 1.2-1.4:

G: the density is not less than 1.4:

The density evaluations are made at initial 100 printing and after that. In the printing test, an image of lateral lines of image ratio of 5% is repeatedly and continuously printed.

Table 2 shows the results.

TABLE 2

| | *1 | *2 | *3 | *4 | *5 | *6 | *7 | *8 |
|---|---|---|---|---|---|---|---|---|
| Emb. 1 Contact DC Elastic Slv | 29 | 10 | G—G | G | G | G | G | G |
| Emb. 7 | 10 | 5 | F—F | F | G | G | G | G |
| Emb. 8 | 46 | 9 | G—G | G | F | G | G | G |
| Emb. 9 | 15 | 14 | G—G | G | G | G | G | G |
| Emb. 10 | 25 | 10 | G—G | G | G | G | G | G |
| Emb. 11 | 45 | 8 | G—G | G | G | G | G | G |
| Emb. 12 | 18 | 14 | G—G | G | G | G | G | G |
| Emb. 13 | 50 | 7 | G—G | G | F | G | G | G |
| Emb. 14 | 45 | 10 | G—G | G | G | G | G | G |
| Comp. Ex. 8 | 8 | 13 | N—N | N | G | G | G | G |
| Comp. Ex. 9 | 46 | 4 | G—G | G | F | G | G | N |
| Comp. Ex. 10 | 13 | 18 | G | — | N | F | N | G |
| Comp. Ex. 11 | 51 | 6 | G—G | G | N | G | G | G |
| Comp. Ex. 12 | 15 | 16 | G | — | N | F | N | G |
| Comp. Ex. 13 | 52 | 7 | G—G | G | N | G | G | G |
| Comp. Ex. 14 | 50 | 4 | G—G | G | F | G | G | N |

*1 Q/M
*2 M/S
*3 a) Fog (100–2000 prints)
*4 b) Fog (When toner is short)
*5 c) Ghost
*6 d) Hair line uniformity
*7 f) Defect in solid white
*8 i) image density of solid black image 1) the description will be made as to the advantages over the present invention in the range of the specific charge and the coating amount when the average circularity of the toner is not less than 0.965. A detailed description will be made referring to Embodiments 7-14 and comparison examples 8-14.

Figure 9:
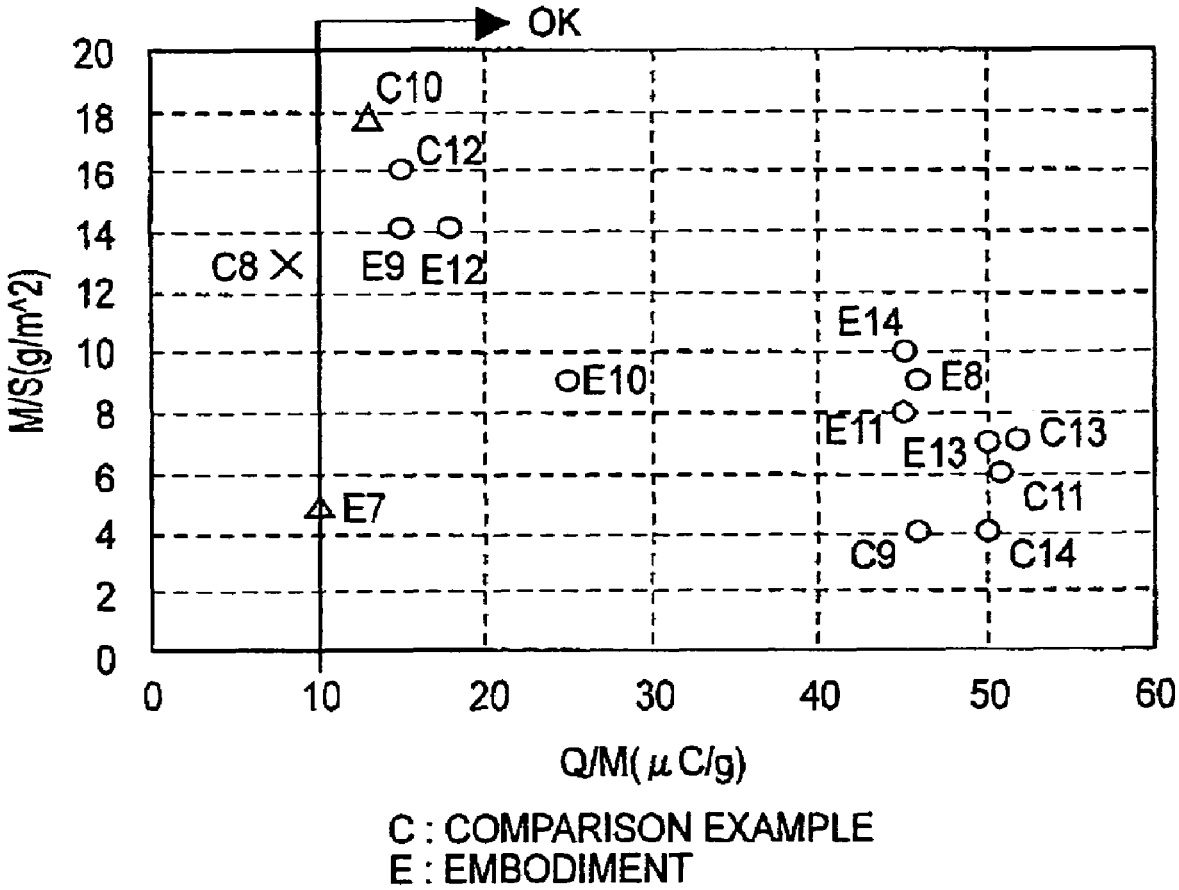
FIG. 9 is a graph showing the results of fog evaluation when the average sphericity of toner was no less than 0.965.

2) in comparison example 8, the specific charge is low, and a certain percentage of the toner has the opposite charge quality, and therefore, the fog is produced. In Embodiment 7, the specific charge is selected to be 10, by which the fog prevention is improved. The results of fog prevention evaluation are shown in FIG. 9. As will be understood from, the specific charge is preferably not less than 10 to improve the fog.

Figure 10:
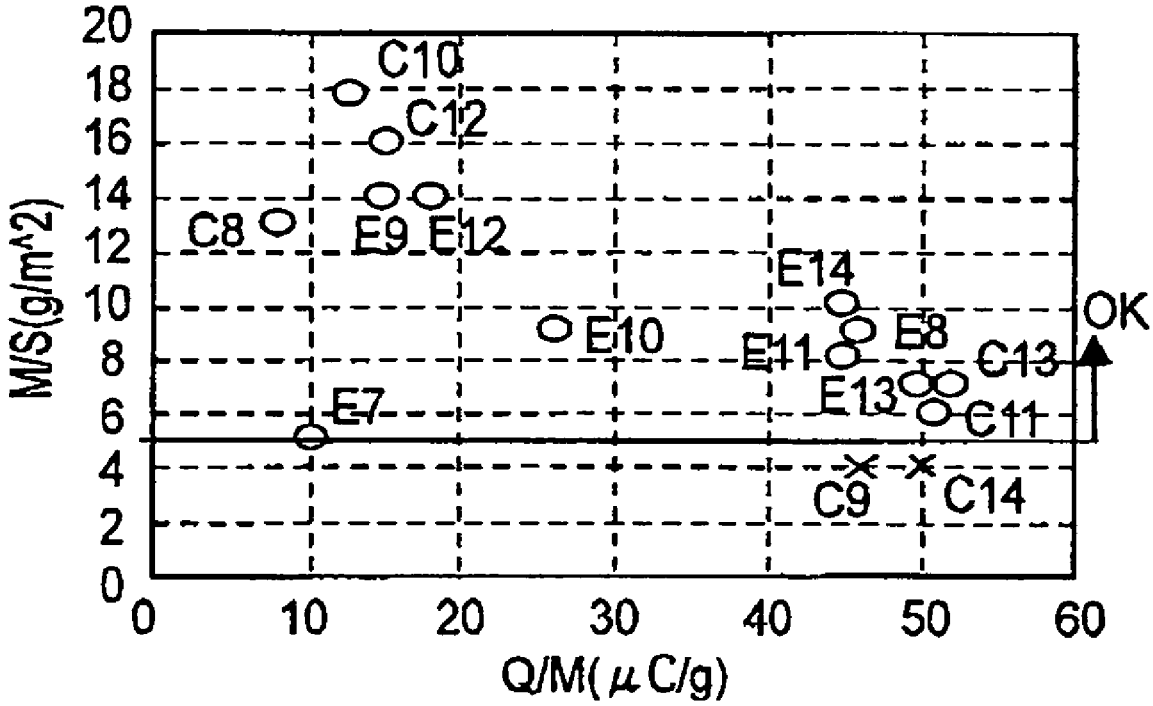
FIG. 10 is a graph showing the results of density evaluation when the average sphericity of toner was no less than 0.965.

3) in comparison examples 9, 14, the coating amount is small, and therefore, the density is not sufficient. FIG. 10 is a graph showing the results of the density evaluation. In order to provide a satisfactory image density, the coating amount of 5 as in Embodiment 7 is preferable.

Figure 11:
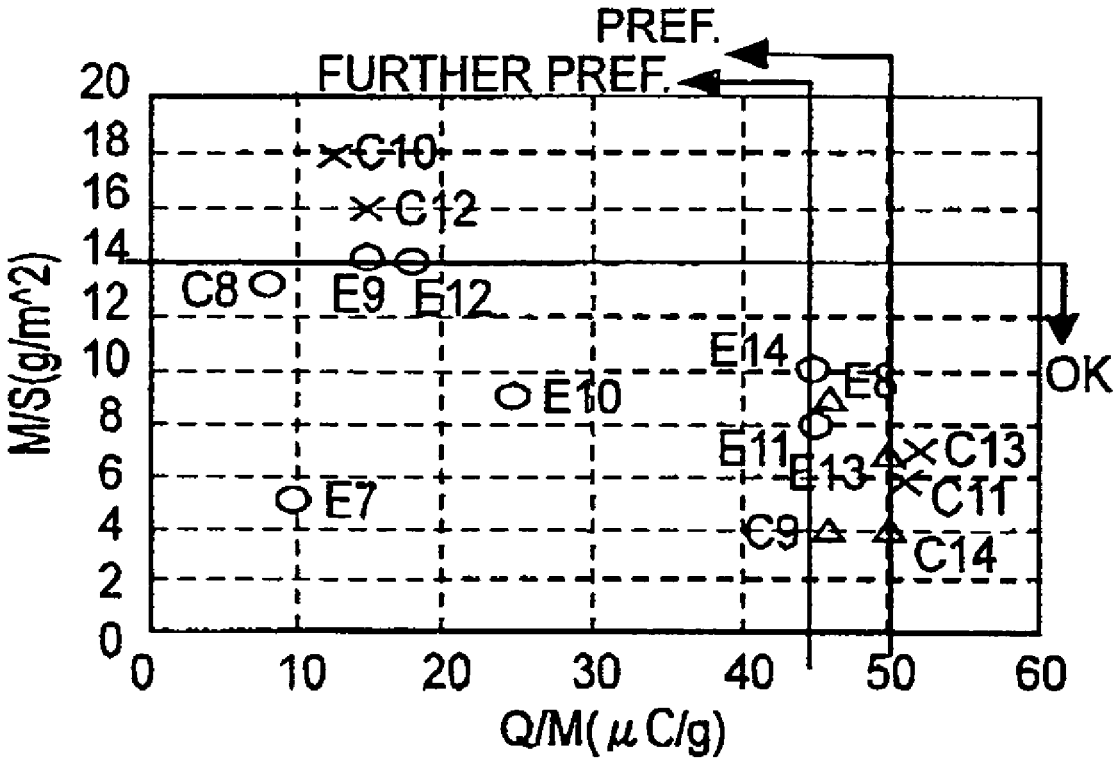
FIG. 11 is a graph showing the results of ghost evaluation when the average sphericity of toner was no less than 0.965.

4) the evaluation from the standpoint of ghost image will be described. FIG. 11 is a graph showing results of evaluation of ghost image prevention.

The mechanism of production of ghost image defect will be considered. The developing device of the embodiments of the present invention comprises a photosensitive drum and a developing sleeve pressed thereto, and it does not include a removing and supplying roller. In such a developing device, a portion of the elastic sleeve from which the toner is consumed in the immediately previous rotation, is supplied with a new toner, and the toner is fed to the regulating portion. When the solid black image is printed, more than 90% of the coated amount of the toner is consumed. Therefore, the toner deposited on the portion from which the toner has been consumed contains a large percentage of newly supplied toner.

On the other hand, the toner on the portion from which the toner is not consumed in the immediately previous rotation, the toner returns to the supply portion as it is. Therefore, the toner deposited after this contains a relatively low percentage of the newly supplied toner. In this manner, the toner fed to the regulating portion involves the difference in the ratio of the new toner to the old toner, depending on the difference in the consumption in the previous rotation. The distribution of the charge on the sleeve can be made uniform by sufficiently mixing the upper part of the toner layer and the lower part of the toner layer immediately before and during passage of the toner through the regulating portion, that is, by removing and supplying the toner relative to the sleeve surface. Then, the toner layer has a uniform distribution of the charge after the passage through the regulating portion, irrespective of the hysteresis of the toner consumption. If such removal and supply of the toner, is not sufficient, the ghost image defect appears on a uniform half-tone image print.

5) the ghost image defect appears in the comparison example 11. In this example, the specific charge is as high as 51, which is considered as the cause of the ghost image production. When the specific charge is high, the depositing force between the elastic sleeve and the toner is high. In the portion from which the toner is not consumed, the exchange of the upper and lower part of the toner layer is not sufficiently replace d, so that difference from the specific charge of the portion from which the toner is consumed. The ghost image defect appears in comparison example 13.

6) in Embodiment 13 and comparison example 14, the specific charge is reduced and set to 50 to decrease the electrostatic depositing force between the elastic sleeve and the toner to allow replace of the toner, the ghost image is improved to an insignificant level. From the foregoing, the specific charge is preferably not more than 50 to improve the ghost image prevention.

7) in Embodiment 8 and comparison example 9, the specific charge is 46, and therefore, the ghost image is insignificant. However, in Embodiments 11, 14, the specific charge is reduced to set at 45, by which the ghost image is further improved to such an extent that substantially no ghost image defect appears.

In order to improvement the ghost image prevention, the specific charge is further preferably not more than 45.

8) in comparison examples, 12, the specific charges are 13, 15 which are within the above-described proper range. Despite the fact, the ghost image defect results. The ghost image defect prevention is not enough only by selecting the specific charge in a proper range, and it is considered that coating amount should also be within a proper range.

9) in comparison examples 10s, 12, the ghost image appears. The reason for this is considered as the coating amounts which are as high as 18, 16. When the coating amount is high, the amount of the toner returning to the supply portion is too large at the portion from which the toner is not consumed, with the result that exchange between the new toner and old toner is insufficient, and therefore, the distribution of the specific charge of the toner is non-uniform, and that ghost image defect appears.

10) in Embodiments 9, 12, the coating amount is 14 and the specific charge are 15, 18, respectively.

From this, the coating amount is preferably not more than 14 to prevent ghost image.

From the foregoing, for sufficient toner removal and supply and sufficient prevention of the ghost image, the specific charge is preferably not more than specific charge 50, and the coating amount is not more than 14, and further preferably the specific charge is not more than 45, and the coating amount is not more than 14.

11) the evaluation will be described from the standpoint of image defect in a solid white image.

In comparison example 10 and comparison example 12, an image defect appears in a solid white image in addition to the ghost image defect. In the comparison examples 10, 12, the coating amount is as high as 18, 16, respectively, and this is considered as the cause of the image defect.

Figure 12:
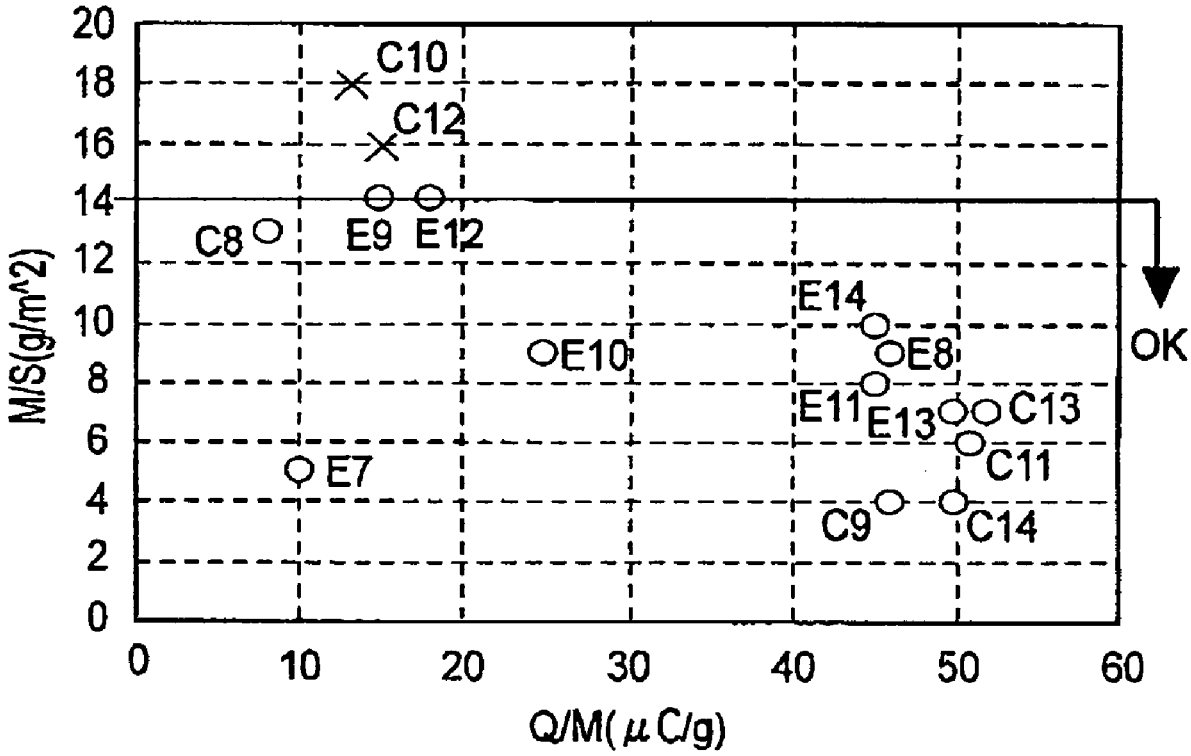
FIG. 12 is a graph showing the results of the evaluation of defects in the solid white (blank) areas of an image when the average sphericity of toner was no less than 0.965.

The mechanism of the production of the solid white image defect is as follows. FIG. 12 is a graph showing the results of evaluation with respect to the solid white image defect prevention. If the coating amount is high as in comparison examples 10, 12, the toner amount returning to the supply portion from the solid white image where the toner is consumed, is large. Therefore, the replace of the new and old toner is insufficient, with the result of non-uniform distribution of the specific charge of the toner coating layer after passage of the regulating portion. When the elastic sleeve carrying such a toner layer is contacted and pressed against the drum during the development, the toner having a specific charge or having opposite polarity charge on the surface layer in the toner coating layer is contacted to and deposited on the drum. This is a cause of the solid white image defect.

In Embodiments 9 and 12, no solid white image defect is produced, and in these embodiments, the coating amounts are 14, and the specific charges are 15, 18, respectively. Therefore, from the standpoint of preventing the image defect in the solid white image, the coating amount is preferably not more than 14.

In comparison examples 10, 12, the hair line uniformity is also poor. This is because the coating amount is too large, which results in formation of long magnetic chains. Therefore, also from the standpoint of hair line uniformity, the toner coating amount is preferably not more than 14.

Figure 13:
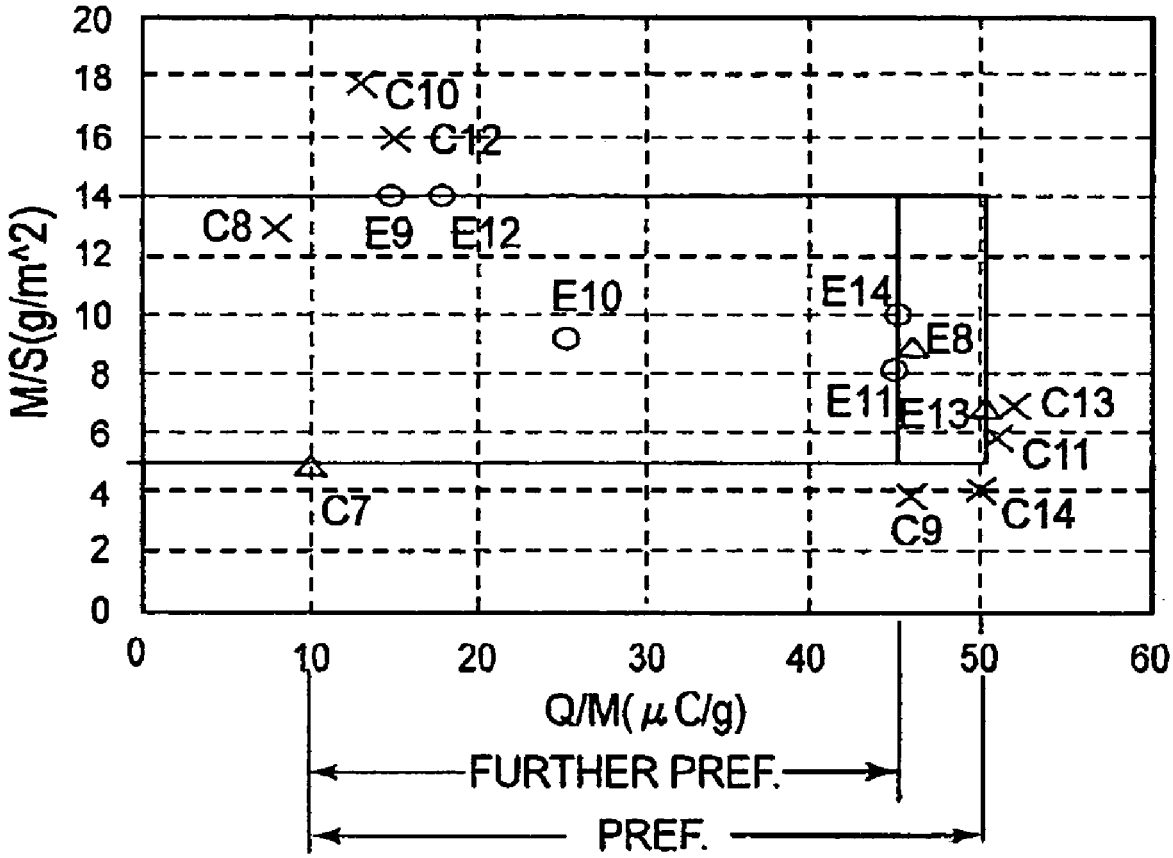
FIG. 13 is a graph showing the results of the overall evaluation of images when the average sphericity of toner was no less than 0.965.

12) from the foregoing comparisons between Embodiments 7-14 and comparison examples 8-14, as shown in FIG. 13, the specific charge is preferably 10-50 μC/g and further preferably 10-45 μC/g. If it is lower than 10 μC/g, the charge of the opposite polarity relatively increases with the result of fog. If it exceeds 50 μC/g, the toner removal from and toner supply to the surface of the elastic sleeve is not sufficient, with the result of ghost image. If it is higher than 45 μC/g and lower than 50 μC/g, an insignificant ghost image is produced.

As regards the coating amount, 5-14 g/m$^2$ is preferable. If it is lower than 5 g/m$^2$, the image density is insufficient. If it is higher than 14 g/m$^2$, the specific charge of the entirety of the toner layer is non-uniformity with the result of image defect in the solid white, and in addition, a ghost image results because of improper removal from and supply to the toner. Furthermore, the magnetic chain is long, and therefore, the hair line uniformity decreases.

13) as described in the foregoing, by effecting the toner supply to the developing sleeve having the elastic layer, the toner can be removed from and supplied to the developing sleeve without deteriorating the toner. Furthermore, by the contact of the elastic sleeve and the drum with each other during the development, satisfactory images can be provided without an image edge defect. This is accomplishment using the one component magnetic toner having the circularity not less than 0.965 under the condition that specific charge of the toner on the elastic sleeve and the coating amount thereon are within a proper range.

The description will be made as to ranges of the specific charge and the toner coating amount under the average circularity of less than 0.965.

1) Embodiments 3, 4, 5, 6, 7 and 8:

The developing device of these embodiments are basically the same as the developing device 60A of Embodiment 1, but are different in the following respects:

As regards the setting of the regulating blade, the drawing pressures are as follows:

45, 55, 55, 55, 65 and 65 N/m, respectively.

The free part lengths of the blades are as follows:

0.3, 0.6, 0.4, 0.3, 0.5 and 0.4 mm, respectively.

The surface roughnesses of the developing sleeve surface Rz are as follows:

2.7, 3.8, 3.8, 3.8, 4.5 and 4.5, respectively.

The surface roughnesses of the developing sleeve surface Rz are as follows:

0.4, 0.6, 0.6, 0.6, 0.7 and 0.7, respectively.

2) comparison examples 8, 9, 10, 11, 12 and 13:

The developing device of these examples are basically the same as the developing device 60A of Embodiment 1, but are different in the following respects:

As regards the setting of the regulating blade, the drawing pressures are as follows:

45, 45, 55, 55, 65 and 65, respectively. The free part lengths of the blades are as follows:

1.0, 0.1, 1.0, 0.1, 1.0 and 0.2, respectively.

The surface roughnesses of the developing sleeve surface Rz are as follows:

2.7, 2.7, 3.8, 3.8, 4.5 and 4.5, respectively.

The surface roughnesses of the developing sleeve surface Rz are as follows:

0.4, 0.4, 0.6, 0.6, 0.7 and 0.7, respectively. 3) evaluation method for the embodiments and the comparison examples:

In scheme 1 type, the image evaluations are made with respect to the a) fog prevention evaluation, b) fog property evaluation when the remaining toner amount is short, d) hair line uniformity and f) solid white image defect. Table 3 shows the results.

TABLE 3

| | *1 | *2 | *3 | *4 | *5 | *6 | *7 |
|---|---|---|---|---|---|---|---|
| Emb. 3 | 16 | 14 | G—G | G | G | G | G |
| Contact DC | | | | | | | |
| Elastic Slv | | | | | | | |
| Low Sphr. | | | | | | | |
| Max. Iron | | | | | | | |
| Emb. 15 | 13 | 8 | F—F | F | G | G | G |
| Emb. 16 | 15 | 15 | G—G | G | G | G | G |
| Emb. 17 | 19 | 12 | G—G | G | G | G | G |
| Emb. 18 | 23 | 10 | G—G | G | G | G | G |
| Emb. 19 | 18 | 15 | G—G | G | G | G | G |
| Emb. 20 | 23 | 12 | G—G | G | G | G | G |
| Comp. Ex. 10 | 10 | 13 | N—N | N | G | G | G |
| Comp. Ex. 19 | 19 | 7 | G—G | G | G | G | N |
| Comp. Ex. 14 | 14 | 20 | F—F | F | F | N | G |
| Comp. Ex. 26 | 26 | 10 | G | — | G | N | G |
| Comp. Ex. 16 | 16 | 18 | G | — | F | N | G |
| Comp. Ex. 26 | 26 | 11 | G | — | G | N | G |

*1 Q/M
*2 M/S
*3 a) Fog (100–2000 prints)
*4 b) Fog (When toner is short)
*5 d) Hair line uniformity
*6 f) Defect in solid white
*7 i) Image density of solid black image 4) the description will be made as to the advantages over the present invention in the range of the specific charge and the coating amount when the average circularity of the toner is less than 0.965. A detailed description will be made referring to Embodiments 15-20 and comparison examples 15-20.

5) in comparison example 15, the specific charge is low, and a certain percentage of the toner has the opposite charge quality, and therefore, the fog is produced.

Figure 14:
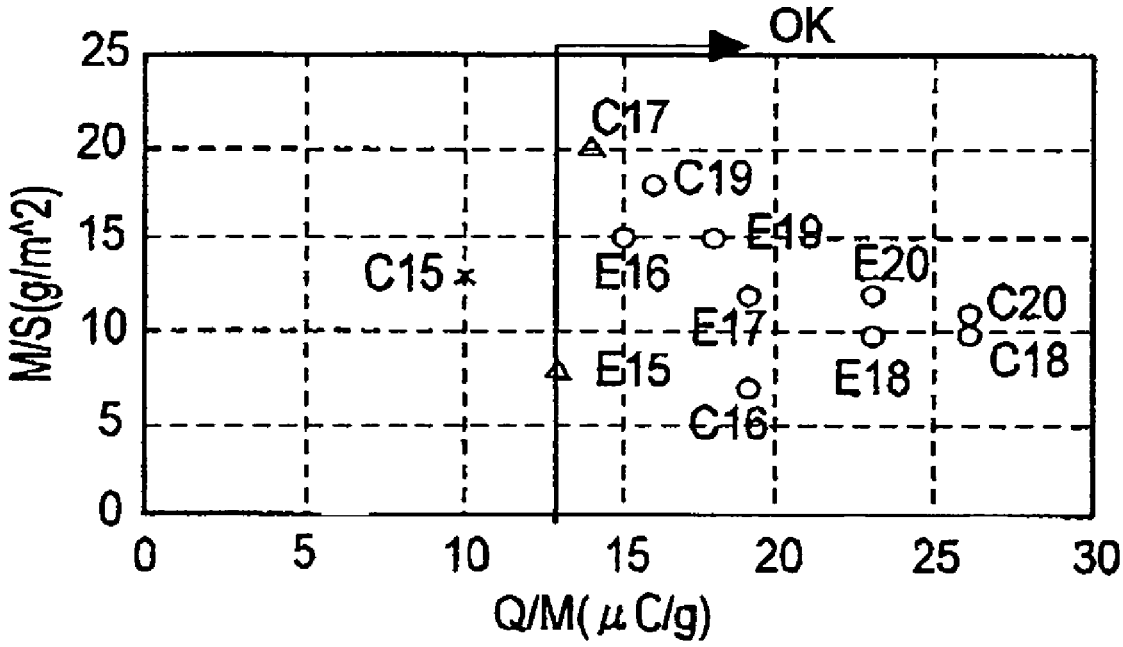
FIG. 14 is a graph showing the results of fog evaluation when the average sphericity of toner was no more than 0.965.

6) in Embodiment 15, the specific charge is selected to be 13, by which the fog prevention is improved. The results of fog prevention evaluation are shown in FIG. 14. As will be understood from, the specific charge is preferably not less than 13 to improve the fog.

Figure 15:
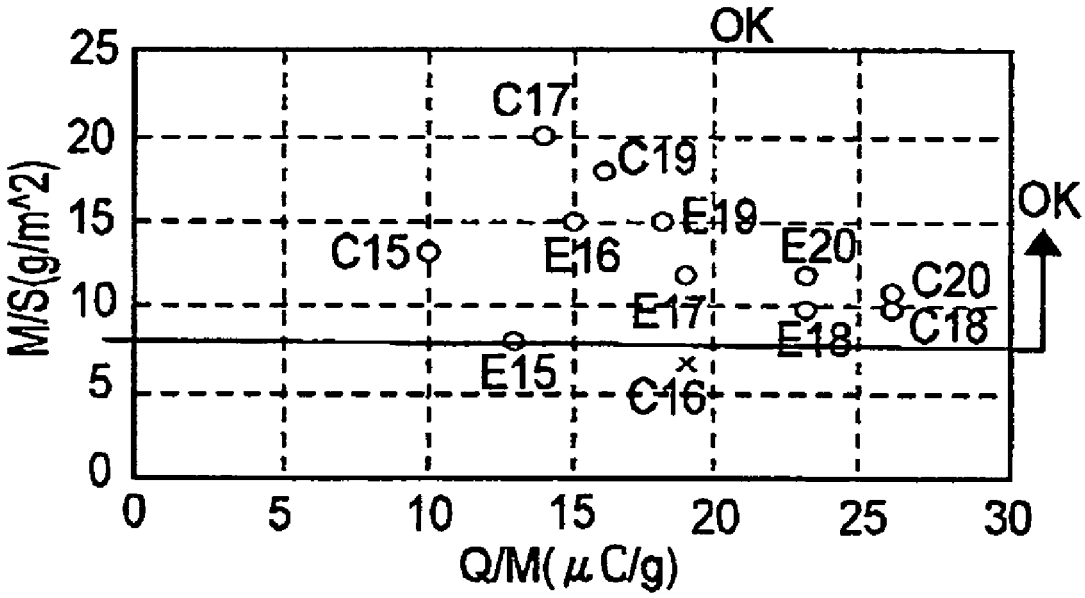
FIG. 15 is a graph showing the results of density evaluation when the average sphericity of toner was no more than 0.965.

7) in comparison examples 16, the coating amount is small, and therefore, the density is not sufficient. FIG. 15 is a graph showing the results of the density evaluation. In order to provide a satisfactory image density, the coating amount of 8 as in Embodiment 8 is preferable.

8) the evaluation from the standpoint of the image defect in the solid white will be described. In comparison examples 18 and 20, an image defect in the solid white appears. In these examples, the specific charge is as high as 26, so that electrostatic depositing force between the toner and the developing sleeve surface is very strong, and therefore, the high charged toner deposited cannot be removed in these examples not provided with mechanical removing and supplying mechanism.

On the other hand, in Embodiments 18 and 20, the specific charge is 23, and the coating amount is 10, 12, respectively, and therefore, the images are satisfactory.

From the foregoing, specific charge is preferably not more than 23, since then the image defect is not produced in the solid white image.

In comparison example 17, the specific charge 14 is satisfactory, but an image defect appears in a solid white image. Therefore, for the prevention of the solid white image defect, it is not enough to set only the specific charge at a proper level. It is considered that there is a proper range limit with respect to the coating amount of the toner, too.

The mechanism of the production of the solid white image defect is as follows. In the developing device having a photosensitive member and a developing sleeve which are pressed to each other, a nucleus of toner deposition is produced on the sleeve at the contact portion between the photosensitive member and the developing sleeve. In these examples, there is not provided a mechanical removing and supplying portion, and therefore, the regulating portion is considered as playing an important role in removing the toner from the surface. When the toner is applied on the sleeve, the regulating portion has a function of toner replacement. If the amount of the coating toner, the toner replace does not reach the surface layer of the sleeve, with the result that toner deposition grows to such an extent that image defect appears on the print.

Therefore, the image defect is caused by too high specific charge of the toner or the too large amount of the coating amount.

Similarly to comparison example 17, an image defect in the solid white image results in comparison example 19.

On the other hand, in Embodiments 16 and 19, the coating amount is 15, and the image recording is satisfactory. From the foregoing, the coating amount of the toner is preferably not more than 15 from the standpoint of preventing the image defect in the solid white image.

In comparison examples 10 and 12, the hair line uniformity is also poor. This is because the coating amount is too large, which results in formation of long magnetic chains. The coating amount of 15 is suitable range also from the standpoint of hair line uniformity.

Figure 17:
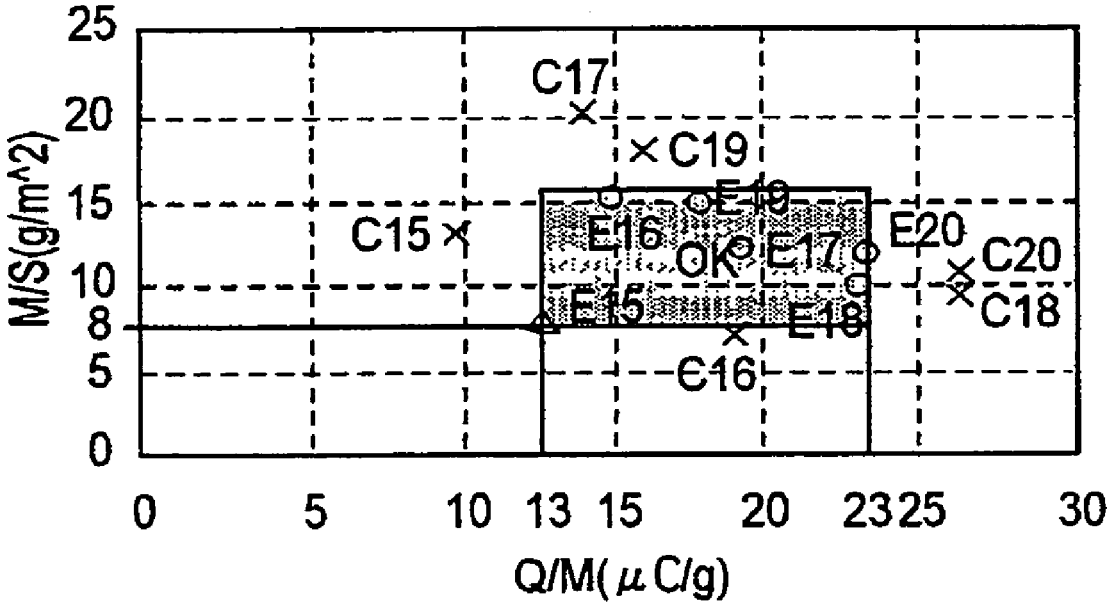
FIG. 17 is a graph showing the results of the overall evaluation of images when the average sphericity of toner was no more than 0.965.

9) from the foregoing comparisons between Embodiments 15-20 and comparison examples 15-20, the specific charge is preferably 13-23 μC/g as shown in FIG. 17. If it is lower than 13, the percentage of the opposite polarity charge increases with the result of fog production. If it exceeds 23, the toner depositing force increases with the result of image defect in a solid white image.

As regards the coating amount, 8-15 g/m$^2$ preferable is preferable. If it is lower than 8, the image density is not sufficient. If it exceeds 15, the replace of the toner by the regulating portion is so poor that image defect is produced in the solid white image. Furthermore, the magnetic chain is long, and therefore, the hair line uniformity decreases.

The advantageous effects provided by the average circularity which is not less than 0.965 will be described.

The following image evaluation has been made with respect to Embodiments 1-3 in order to check the superiorities of the average circularity which is not less than 0.965. Under the foregoing evaluations evaluation method a)-i) and A)-D), there is no difference among Embodiments 1-3.

The image evaluation with a larger load than with the foregoing image evaluation has been made. More particularly, 3000 sheets printing of lateral lines with print ratio 2% are intermittently carried out under the evaluation ambience of 32.5° C., 80% Rh. Here, the intermittent printing means printing one by one, which is different from the continuous printing in that pre-rotations and post-rotations of the photosensitive drum are carried out. Under these conditions, the toner, the regulating member, the elastic sleeve, the drum and the like are more easily deteriorated. In the intermittent mode, the evaluation have been made.

1) method of image evaluations:

First, the image evaluation method for scheme 1 type will be described:

i) fog (intermittent):

The measuring method of the amount of the fog and the ranking thereof are the same as with foregoing a).

ii) ghost image (intermittent):

The evaluation method of the ghost image and the ranking thereof are the same as with foregoing c).

iii) image defect (intermittent) provided by longitudinal stripe attributable to toner fusing on the regulating member:

If the toner fusing occurs on the regulating member, longitudinal stripe image defect (white) occurs. Such a longitudinal stripe image defect is checked with respect to the solid black image and the halftone image.

The scanner machine used in the tests is a 600 dpi laser scanner. In the tests, the halftone image is represented by an image comprising 1 line extending in the main scan direction and subsequent non-printed 2 lines. The image thus provided, as a total, represents a half-tone image.

N: a longitudinal stripe is recognizable in the solid black image:

F: a longitudinal stripe is recognizable:

G: a longitudinal stripe is recognizable neither in the solid black image nor in the halftone image:

iv) measurement of an amount of drum scraping:

The amount of drum scraping is measured using a photosensitive drum film thickness measurement system available from Ohtsuka Denshi Kabushiki Kaisha (MCPD-3000). The film thickness of the drum is measured before the drum starts to be used and after the 3000 sheets intermittent printing, and the difference of the measurements is taken as the drum scraping amount.

N: the drum scraping amount is not less than 0.5 μm:

F: the drum scraping amount is not less than 0.2 μm and less than 0.5 μm:

G: the drum scraping amount is less than 0.2μ.

First, the image evaluation method for scheme 2 type will be described:

v) halftone image defect attributable to drum damage:

If a drum damage occurs, a defect of approximately 0.5-2.0 mm extending in the drum peripheral movement at the intervals corresponding to the cyclic period of the drum rotation in a halftone image. The evaluation in this respect is made on the basis of the number of defects in a halftone image defect.

The scanner machine used in the tests is a 600 dpi laser scanner. In the tests, the halftone image is represented by an image comprising 1 line extending in the main scan direction and subsequent non-printed 2 lines. The image thus provided, as a total, represents a half-tone image.

N: the number of defects in a halftone image of 0.5-2.0 mm is not less than 10:

F: the number of defects in a halftone image of 0.5-2.0 mm is not less than 4 and less than 10:

G: the number of defects in a halftone image of 0.5-2.0 mm is less than 4:

In these evaluations, only the damage in the print appearing at the interval of the drum cyclic period to extract the noted defect from the other image defect.

Table 4 shows the results of these image evaluations i)-v).

TABLE 4

| | *1 | *2 | *3 | *4 | *5 | *6 | *7 |
|---|---|---|---|---|---|---|---|
| Emb. 1 | 0.976 | 0.001 | G | G | G | G | G |
| Emb. 2 | 0.968 | 0.01 | G | F | G | G | F |
| Emb. 3 | 0.950 | 0.01 | F | F | F | F | N |

*1 Ave. Circularity
*2 B/A
*3 i) Fog (intermittent)
*4 ii) Ghost (intermittent)
*5 iii) Defect of longitudinal stipes by toner fusion on blade
*6 iv) Amount of drum scrape
*7 v) Defect in halftone imge by drum damage Advantageous effects provided by the circularity being not less than 0.965.

1) fog (intermittent):

With Embodiments 1, 2, the result is in G rank, and with Embodiment 3, the rank is F. In Embodiment 3, the toner shape is more irregular, the toner is deteriorated by the sliding contact at the regulating portion and the sliding contact at the developing zone more than in Embodiments 1, 2, and this is considered as the cause of increase of the fog.

The fog amount on the drum is measured through the following measuring method. The measurement of the fog amount per se is the same as with the measurement of the fog amount on paper, but the measurement of the same on the drum is different in the following points. The toner on the drum is transferred on a transparent tape, which in turn is stuck on a plain paper, and the reflectance of the toner is measured in the same manner as with the fog measurement, and the measurement is deducted by a measurement of the reflectance from a fresh transparent tape without the toner, and is taken as the fog amount on the toner.

In Embodiments 1, 2, the fog amount on the drum is approximately 5%, but it is less than 1% on the printed sheet of paper. On the other hand, in Embodiment 3, the fog amount is approximately 6% on the drum, but on the printed sheet, it is 2%. It is understood that spherical toner in the fog on the drum is less easily transferred onto the sheet than the irregular toner.

When, therefore, the use is made with one component magnetic toner having a circularity of not less than 0.965, the toner deterioration is less easy, and even if the deterioration occurs and causes to produce the fog, the fog toner is less easily transferred onto the sheet, and therefore, the image defect is less.

In terms of suppression of the fog, it is preferable to use one component magnetic toner having an average circularity not less than 0.965.

2) results of evaluation of ghost image (intermittent):

With Embodiments 1, the result is in G rank, and with Embodiments 2 and 3, the rank is F. Because of the existence of the magnetic material on the surface, rising of the triboelectric charging is considered as being poor. Due to the deterioration of the toner, the surface of the toner is scraped, and the surface magnetic member amount relatively increases, with the result of the remarkable difference in the ghost image defect.

When the ghost images of the Embodiment 2 and Embodiment 3, the ranks are both in F, but the density difference between the ghost image portion and the background halftone image is slightly larger in Embodiment 3 than in Embodiment 2. The reason is considered as follows. The shape of the toner used in Embodiment 3 is more irregular than that used in Embodiment 2, and therefore, the deterioration is quicker. Because of this, the charging property more easily deteriorates due to the relative increase of the amount of the surface magnetic member and the embedded in g and slipping off of the externally added material, with the result of worse ghost image.

From the foregoing, it is understood that use of one component magnetic toner having a circularity of not less than 0.965 is preferable in terms of improvement of ghost image prevention, and that one component magnetic toner preferably has B/A value of not more than 0.001.

3) longitudinal stripe image defect due to fusing of toner on developing blade:

In Embodiments 1, 2, the longitudinal stripe image defect does not appear, and the scraping amount of the surface of the elastic layer and the drum scraping amount are also small. On the other hand, in Embodiment 3, the ranks are both F. The reason is considered as follows. In Embodiment 3, the toner is irregular, and therefore, the pressures received by the respective toner particles are not even, and there are locally very high pressure, where the toner fusing or the scraping of the surface of the drum occurs. On the other hand, in Embodiments 1, 2 using the spherical toner, the pressures received by respective toner particles from the regulating member and the elastic sleeve in the regulating portion are even, so that occurrence of local very high pressure is avoided, and therefore, the fusing or surface scraping occurs.

In Embodiments 2, 3, a defect in the form of thin stripes is produced on the regulating members although it does not appear as an image defect. This is considered as being caused by the large amount of the magnetic material at the surface which leads to the damage to the regulating member.

Additionally, there is an insignificant smear of letters in Embodiment 3. The reason is considered as follows. The scraping of the drum leads to decrease is in the sensitivity of the photosensitive drum, with the result of incapability of faithfull latent image formation.

From the foregoing, it is preferable to use one component magnetic toner having an average circularity of not less than 0.965 in terms of suppression of blade fusing of the toner and suppression of drum scraping, and it is further preferable that B/A value thereof is not more than 0.001 in terms of prevention of thin damages of the regulating member.

In addition, the results suggest that when the use is made with one component magnetic toner having an average circularity of not less than 0.965, the load between the regulating member and the elastic sleeve and between the drum and the elastic sleeve are small. From this, the torque required to a motor of the image forming apparatus would be relatively small. In addition, since the load is small, the downsizing would be possible.

4) results of image evaluation of the halftone image defect (scheme 2) due to drum damage:

In Embodiment 1, the halftone image defect due to the drum damage does not appear, but in Embodiment 2, an insignificant drum damage appears, and in Embodiment 3, a halftone image defect due to drum damage appears.

The cause is considered as follows. In the present invention, the elastic sleeve is contacted to and pressed against the photosensitive drum, and therefore, the drum damage tends to occur in the developing zone under the presence of the magnetic material at the surface of the toner. In addition, since the cleaner-less system is employed, the toner is interpositioned between the photosensitive drum and the charging roller (in the nip), which also increases the possibility of drum damage. Since the toner used in Embodiment 3 is irregular in shape, there are non-uniformity in the physical forces and in the electrical forces due to uneven charge, and therefore, there is a locally very high pressure between photosensitive drum and the elastic sleeve and between the photosensitive drum and the charging roller. This gives rise to a tendency of drum damage by the magnetic material existing at the surface of the toner particles, and in addition, when the deterioration of the toner promotes the irregularity, such a non-uniformity in the physical forces and the non-uniformity in the electrical forces is enhanced with the result that drum damage by the magnetic material at the surface of the toner worsens to such an extent that damage appears as the halftone image defect.

In Embodiment 2, the insignificant halftone image defect due to the drum damage appears. This would be because of increase in the amount of the magnetic material at the surface of the toner particles, which leads to production of scratches on the surface of the drum. That is, the deterioration of the toner exposes the magnetic material.

From the foregoing, it is preferable to use one component magnetic toner having an average circularity not less than 0.965 in terms of suppression of the halftone image defect attributable to the drum damage, and it is further preferable that B/A value is not more than 0.001.

Other advantageous effects will be described.

5) toner consumption amount (comparison between the device of FIG. 10 and the device of FIG. 15):

In the embodiments wherein the average circularity of the toner is not less than 0.965, the lower limit value of the toner coating amount is 5.0 g/m$^2$ in terms of the density of the solid black image as shown in FIG. 10, and in the embodiments wherein the average circularity is less than 0.965, the lower limit value of the toner coating amount is 8.0 g/m$^2$ as shown in FIG. 15. This result suggest that toner consumption amount is smaller when the average circularity of the toner is not less than 0.965 than when the average circularity is less than 0.965, and particularly in the case of toner recycling type and cleaner-less type system (scheme 2), the toner consumption amount is further smaller.

Therefore, when the one component magnetic toner having an average circularity of not less than 0.965, the developing device, the process cartridge and the image forming apparatus may be downsized.

6) as will be understood from the description above the upper limit value of the specific charge and the solid white image defect (comparison between the FIG. 11 and FIG. 16) and from the description of the embodiments wherein the average circularity is not less than 0.965, as shown in FIG. 11, the upper limit value of the specific charge of the toner is 50 μC/g, and it is further preferably 45 μC/g. On the other hand, in the embodiments wherein the average circularity is less than 0965, the upper limit value of the specific charge of the toner is 23 μC/g.

Figure 16:
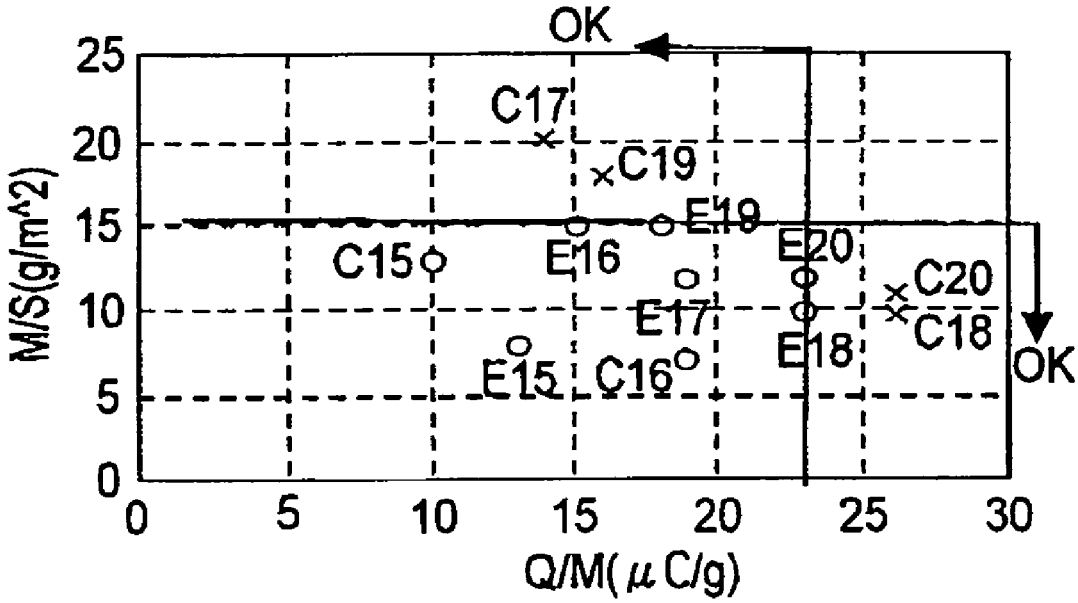
FIG. 16 is a graph showing the results of the evaluation of defects in the solid white (blank) areas of an image when the average sphericity of toner was no more than 0.965.

The upper limit value of the specific charge is selected from the standpoint of ghost image prevention (FIG. 11) in the embodiments wherein the average circularity is not less than 0.965, and is selected from the standpoint of solid white image defect prevention in the embodiments wherein the average circularity is less than 0.965. If the solid white image defect prevention effect is singled out, the solid white image defect decreases (FIG. 12) irrespective of the specific charge, if the coating amount is not more than 14 g/m$^2$ in the case of the average circularity not less than 0.965. And, the upper limit value of the specific charge can be made higher than in the case of the average circularity less than 0.965 (FIG. 16). However, if the ghost image prevention effect is also taken into account, the upper limit value of the specific charge is preferably 50 μC/g and further preferably 45 μC/g.

In other words, when the average circularity of the toner particle is not less than 0.965, the solid white image defect can be suppressed, and the preferable range of the specific charge can be expanded. Then, satisfactory images can be formed irrespective of ambience variation, deterioration with elapse of time, variation of the specific charge.

7) problem arising from solid white image defect in the cleanerless type:

If the solid white image defect occurs in an apparatus using a cleaner-less system, the transfer roller is contaminated with the toner, in addition to the production of the image defect, and as a result, the charging roller is contaminated by the toner, and therefore, the photosensitive drum is not sufficiently charged to the desired charge amount, and the toner transfers even in the non-printing area. If this occurs, the whole surface of the drum becomes black. It this is worsened, the fixing device is contaminated, and/or the sheet wraps around a fixing roller or the like, which leads to apparatus failure. The average circularity of not less than 0.965 is effective to remarkably suppress a cause of such a significant problem in the cleaner-less system.

8) from the foregoing, the feature of the one component magnetic toner having the average circularity not less than 0.965 is advantageous in the suppressions of the fog, the ghost image, the blade fusing, the drum scraping, the scraping of the surface of the elastic layer and the drum damage, particularly when the load to the toner particles is large, namely, the toner tends to deteriorate. Furthermore, by selecting the ratio B/A (the ratio (B/A) between the content (A) of carbon element existing at the surface of the magnetic toner particle and the content of iron element (B), measured by X-ray photoelectron spectrum analysis) of not more than 0.001, the suppression effects are further enhanced.

These advantages are effective to reduce the motor torque in the image forming apparatus, to raise the process speed and to downsize the developing device, the process cartridge and the developing device used with the developing device.

Furthermore, the solid white image defect can be remarkable suppressed irrespective of the specific charge, and therefore, the usable range of the specific charge can be expanded.

As a result, satisfactory images can be stably produced irrespective of the variation of the specific charge attributable to deterioration of the toner due to the ambience variation and elapse time.

In addition, the solid white image defect which may leads to an apparatus failure can be suppressed in the cleaner-less system.

It is further preferable that average circularity is not less than 0.970 in view of the image evaluations made in the foregoing.

In the embodiments of the present invention, the average circularity is not less than 0.92.

Other examples of the image recording device:

1) the image recording device has been described as a laser beam printer as an example, but this is not limiting, and the present invention is applicable to other image forming apparatuses such as an electrophotographic copying machine, a facsimile machine, a word processor and the like.

2) the image bearing member (a member to be developed) is a dielectric member for electrostatic recording, in the case of an electrostatic recording apparatus.

3) the developing device of the present invention is not limitedly for an image bearing member of an image recording device (an electrophotographic photosensitive member, a dielectric member for electrostatic recording or the like), but is usable with other members to be developed, developing process means (including particle collector).

The advantageous effects of the embodiments are as summarized in the following.

A: when the developer (one component magnetic toner) has an average circularity of not less than 0.965.

1) in the contact developing system using magnetic one component developer, by using the developer amount per unit area is 5-14 g/m$^2$, and the specific charge of 10-50 μC/g, the following advantageous effects are provided.

(Effect 1-1) <a) Fog Evaluation in Table 1>

The developer is one component magnetic toner and is attracted to a developer-carrying member by a fixed magnetic field generation means disposed in the developer-carrying member, whereby the developer is magnetically conveyed onto the developer-carrying member. As a result, a developer supply roller for supplying the developer onto the developer-carrying member is not required and a stress exerted on the toner is low, so that even when the number of printing sheets is increased (particularly at a low print ratio), it is possible to considerably prevent a deterioration of the developer to suppress an increase in amount of fog due to the developer deterioration.

(Effect 2-1) <b) Fog Evaluation (When Toner is Short) in Table 1>

The developer is one component magnetic toner and is attracted to a developer-carrying member by a fixed magnetic field generation means disposed in the developer-carrying member, whereby the developer is magnetically conveyed onto the developer-carrying member. As a result, a developer supply roller for supplying the developer onto the developer-carrying member is not required, so that it is possible to considerably prevent a deterioration of the developer to suppress an increase in amount of fog by shaking a cartridge to mix the deteriorated developer and less deteriorated developer when the toner is short.

(Effect 3-1) <h) Evaluation of Defect in Halftone Image in Table 1>

The developer is one component magnetic toner and is attracted to a developer-carrying member by a fixed magnetic field generation means disposed in the developer-carrying member, whereby the developer is magnetically conveyed onto the developer-carrying member. As a result, a developer supply roller for supplying the developer onto the developer-carrying member is not required and a stress exerted on the toner is low, so that even when the number of printing sheets is increased, it is possible to suppress such an image defect that agglomeration of toner is formed on the developer supply roller by frictional contact of the developer supply roller with the developer-carrying member to be moved and deposited in the halftone image.

(Effect 4-1) <g) Toner Scattering Evaluation in Table 1>

The developer is one component magnetic toner and is attracted to a developer-carrying member by a fixed magnetic field generation means disposed in the developer-carrying member, whereby the developer is magnetically conveyed onto the developer-carrying member. As a result, even when a lowering in electrical charge imparting performance due to a deterioration of developer is caused to occur, the developer is constrained by the magnetic force, so that it is possible to suppress scattering of the developer toward the outside of a developer vessel.

(Effect 5-1) <c) Ghost Evaluation in Table 1>

The member to be developed is subjected to development with developer while the member to be developed is pressed by the developer-carrying member, and the developer is one component magnetic toner having an average circularity of not less than 0.970 and is attracted to a developer-carrying member by a fixed magnetic field generation means disposed in the developer-carrying member. As a result, a developer which has been regulated in amount during the development has an amount per unit area of 5-14 g/m$^2$ and a specific charge of 10-50 μC/g, so that it becomes possible to effectively peel off and supply the toner to suppress development ghost.

(Effect 6-1) <Realization of Suppression of Fog in Effects 1 and 2 and Suppression of Ghost in Effect 5 in Combination>

The member to be developed is subjected to development with developer while the member to be developed is pressed by the developer-carrying member, and the developer is one component magnetic toner having an average circularity of not less than 0.970 and is attracted to a developer-carrying member by a fixed magnetic field generation means disposed in the developer-carrying member. As a result, a developer which has been regulated in amount during the development has an amount per unit area of 5-14 g/m$^2$ and a specific charge of 10-50 μC/g, so that it becomes possible to effectively peel off and supply the toner to suppress an increase in fog amount due to toner deterioration and suppress development ghost. Consequently, it is possible to compatibly realize suppression of fog amount and ghost image defect.

(Effect 7-1) <f) Evaluation of Solid White Image Failure in Table 1 (Effect Based on a Comparison Between FIGS. 12 and 16>

The member to be developed is subjected to development with developer while the member to be developed is pressed by the developer-carrying member, and the developer is one component magnetic toner having an average circularity of not less than 0.965 and is attracted to a developer-carrying member by a fixed magnetic field generation means disposed in the developer-carrying member. As a result, a developer which has been regulated in amount during the development has an amount per unit area of 5-14 g/m$^2$, so that it becomes possible to effectively peel off and supply the toner irrespective of a change in specific charge to provide a uniform distribution of the specific charge in the toner coat layer, whereby it is possible to suppress solid white image defect.

(Effect 8-1) <Effect Resulting from Effect 7>

The member to be developed is subjected to development with developer while the member to be developed is pressed by the developer-carrying member, and the developer is one component magnetic toner having an average circularity of not less than 0.970 and is attracted to a developer-carrying member by a fixed magnetic field generation means disposed in the developer-carrying member. As a result, a developer which has been regulated in amount during the development has an amount per unit area of 5-14 g/m$^2$ to suppress solid white image defect and has a specific charge in a proper and wide range of 10-50 μC/g, so that it is possible to provide a wide margin for a fluctuation in specific charge, when the toner is deteriorated due to environmental change and change with time, thereby to suppress each image defect due to the fluctuation in specific charge.

(Effect 9) <i) Fog (Intermittent) Evaluation in Table 4>

The developer is one component magnetic toner having an average circularity of not less than 0.965 and is attracted to a developer-carrying member by a fixed magnetic field generation means disposed in the developer-carrying member, whereby the developer is magnetically conveyed onto the developer-carrying member. As a result, a pressure exerted on an individual toner particle by frictional contact between a regulation member and the developer-carrying member or between an image bearing member and the developer-carrying member becomes uniform, so that even when the number of printing sheets is increased in a print mode more liable to cause toner deterioration, such as intermittent print mode, it is possible to considerably prevent a deterioration of the developer to suppress an increase in amount of fog due to the developer deterioration.

(Effect 10) <iv) Evaluation of Amount of Drum Scrape in Table 4>

The developer is one component magnetic toner having an average circularity of not less than 0.965 and is attracted to a developer-carrying member by a fixed magnetic field generation means disposed in the developer-carrying member, whereby the developer is magnetically conveyed onto the developer-carrying member. As a result, a pressure exerted on an individual toner particle by frictional contact between a regulation member and the developer-carrying member or between an image bearing member and the developer-carrying member becomes uniform, so that even when the number of printing sheets is increased in a print mode more liable to cause toner deterioration, such as intermittent print mode, it is possible to considerably suppress an amount of drum scrape on the surface of the image bearing member and suppress a lowering in sensitivity of a photosensitive member as the image bearing member.

(Effect 11) <iii) Evaluation of Defect of Longitudinal Stripes by Toner Fusion on Developing Blade in Table 4>

The developer is one component magnetic toner having an average circularity of not less than 0.965 and is attracted to a developer-carrying member by a fixed magnetic field generation means disposed in the developer-carrying member, whereby the developer is magnetically conveyed onto the developer-carrying member. As a result, a pressure exerted on an individual toner particle by frictional contact between a regulation member and the developer-carrying member becomes uniform, so that even when the number of printing sheets is increased in a print mode more liable to cause toner deterioration, such as intermittent print mode, it is possible to considerably suppress toner fusion on the surface of the regulation member.

(Effect 12) <Effect Resulting from Effects 10 and 11>

By effect 10 of reducing the amount of image bearing member scrape and Effect 11 of suppressing the toner fusion on the regulation member, a stress between the image bearing member and the developer-carrying member or between the developer amount regulation member and the developer-carrying member is reduced. As a result, it becomes possible to realize an improvement in process speed, a small-sized process cartridge, and a small-sized image forming apparatus.

(Effect 13) <Effect Based on a Comparison Between FIGS. 10 and 15>

The member to be developed is subjected to development with developer while the member to be developed is pressed by the developer-carrying member, and the developer is one component magnetic toner having an average circularity of not less than 0.970 and is attracted to a developer-carrying member by a fixed magnetic field generation means disposed in the developer-carrying member. As a result, even when a developer which has been regulated in amount during the development has an amount per unit area of 5 g/m$^2$ which is a lower limit value, it is possible to form an image having a sufficient density without decreasing a solid black image density to reduce toner consumption.

(Effect 14) <Effect Resulting from Effect 13>

By effect 13 of reducing the amount of toner consumption, it becomes possible to realize a small-sized developing apparatus, a small-sized process cartridge, and a small-sized image forming apparatus.

(Effect 15) <Effect, Larger than Effect 5, by Evaluation with FIG. 11>

The developer has an amount per unit area of 5-14 g/m$^2$ and a specific charge of 10-45 μC/g, so that it is possible to achieve an effect of further suppressing the image defect due to ghost, compared with Effect 5.

(Effect 16) <Effect Achieved Through Observation During Evaluation of Effect 14>

A ratio (B/A) of an iron element content (B) to a carbon element content (A), present at the surface of the above described developer, measured according to X-ray photoelectron spectroscopy is not more than 0.001, so that in a print mode liable to cause toner deterioration, such as intermittent print mode, an occurrence of damage of the regulation member, by the magnetic material present at the toner surface, due to frictional contact between the regulation member and the developer-carrying member can be considerably suppressed.

(Effect 17) <ii) Ghost (Intermittent) Evaluation in Table 4>

A ratio (B/A) of an iron element content (B) to a carbon element content (A), present at the surface of the above described developer, measured according to X-ray photoelectron spectroscopy is not more than 0.001, so that in a print mode liable to cause toner deterioration, such as intermittent print mode, it is possible to realize less toner deterioration and considerably suppress the development ghost even when the number of print sheets is increased.

(Effect 18-1) <d) Evaluation of Hair Line Uniformity in Table 1>

A member to be developed is subjected to lo development with developer while applying a direct-current (DC) voltage as a developing bias (voltage) and pressing the developer-carrying member against an image bearing member as the member to be charged, whereby tailing of toner is suppressed, thereby to improve a thin line uniformity.

(Effect 19-1) <e) Evaluation of Image Edge Defect in Table 1>

A member to be developed is subjected to development with developer while applying a direct-current (DC) voltage as a developing bias (voltage) and pressing the developer-carrying member against an image bearing member as the member to be charged, whereby an edge of a high-density portion particularly on a downstream side of the process is developed with a high density, and an edge of a halftone portion adjacent to the high-density portion is developed with a low density. As a result, it is possible to suppress an image edge defect.

(Effect 20-1) <A) Evaluation of Toner Collection (Cleanerless) in Table 1>

In a cleanerless system, an image bearing member and a developer-carrying member are pressed against each other, so that a distance therebetween becomes small to increase an area on which an electric field or a magnetic field acts and a strength of the electric field or the magnetic field. As a result, it is possible to improve a collection performance of developer remaining and deposited, after transfer, on an non-exposure portion of the image bearing member.

(Effect 21-1) <B) Evaluation of Defect in Halftone Image (Embodiment 2) in Table 1>

In a cleanerless system, the developer is one component magnetic toner and is attracted to a developer-carrying member by a fixed magnetic field generation means disposed in the developer-carrying member, whereby the developer is magnetically conveyed onto the developer-carrying member. As a result, a developer supply roller for supplying the developer onto the developer-carrying member is not required, so that it is possible to suppress toner deterioration due to returned toner, an occurrence of agglomerated toner grown from a contaminant contained in the returned toner as a seed, and a defect in halftone image due to deposition of the agglomerated toner on the developer supply roller.

(Effect 22-1) <C) Evaluation of Defect in Halftone Image by Paper Dust in Table 1>

In a cleanerless system, the developer is one component magnetic toner and is attracted to a developer-carrying member by a fixed magnetic field generation means disposed in the developer-carrying member, whereby the developer is magnetically conveyed onto the developer-carrying member. As a result, a developer supply roller for supplying the developer onto the developer-carrying member is not required, so that even when the number of printing sheets is increased, it is possible to suppress such an image defect in halftone image occurring every full circumference of the developer-carrying member due to peeling-off and supply failure of the toner, caused by frictional contact between the developer supply roller and the developer-carrying member leading to residual paper dust, contained in the returned toner, remaining in the developer supply roller.

(Effect 23-1) <D) Evaluation of Defect in Solid Black Image in Table 1>

In a cleanerless system, a member to be developed is subjected to development with developer while applying a direct-current (DC) voltage as a developing bias (voltage) and pressing the developer-carrying member against an image bearing member as the member to be charged, whereby it is possible to suppress an image defect in a solid black image due to white spots therein by suppressing leakage generated through paper dust contained in the returned toner in a high-temperature and high-humidity environment.

(Effect 24) <v) Evaluation of Defect in Halftone Image by Drum Damage in Table 4)

In a cleanerless system, one component magnetic toner having an average circularity of not less than 0.970 is used. As a result, even when toner deterioration is accelerated by increasing the number of printing sheets particularly in such a print mode as intermittent print mode that an ununiform stress due to inclusion of irregular-shaped toner between the developer-carrying member and the image bearing member or between the charging means and the image bearing member is caused to occur and thus the toner is liable to be deteriorated, it is possible to suppress drum damage leading to a defect in halftone image occurring every full circumference of the drum.

(Effect 25) <v) Evaluation of Defect in Halftone Image by Drum Damage in Table 4>

In a cleanerless system, developer has an average circularity of not less than 0.970, and a ratio (B/A) of an iron element content (B) to a carbon element content (A), present at the surface of the above described developer, measured according to X-ray photoelectron spectroscopy is not more than 0.001, so that it is possible to further improve Effect 24 of suppressing drum damage, thereby to further effectively suppress the defect in halftone image occurring every full circumference of the drum.

(Effect 26) <Effect More Than Effect 13 by Toner Recycling (Cleanerless)>

In a cleanerless system, by performing toner recycling, it is possible to further enhance Effect 13 of reducing the toner consumption.

(Effect 27) <Effect Resulting from Effect 26>

In a cleanerless system, by Effect of reducing the toner consumption, it is possible to further effectively realize reduction in size of a developing apparatus, a process cartridge, and an image forming apparatus.

(Effect 28) <Effect Resulting from Effect 7 in Cleanerless System>

In a cleanerless system, by providing the developer with an average circularity of not less than 0.970, it is possible to attain Effect 7 of suppressing the defect in solid white image irrespective of the specific charge. Further, it is possible to suppress an occurrence of such an apparatus trouble that the occurrence of the defect in solid white image causes contamination of the charge roller, whereby an entire black image is formed due to complete charge failure and a material to be transferred is wound around a fixing device.

B: Effects in the case where developer has an average circularity of less than 0.965 as n Embodiments 12-19 of the present invention (Effect 1-2) <a) Fog Evaluation in Table 1>

The developer is one component magnetic toner and is attracted to a developer-carrying member by a fixed magnetic field generation means disposed in the developer-carrying member, whereby the developer is magnetically conveyed onto the developer-carrying member. As a result, a developer supply roller for supplying the developer onto the developer-carrying member is not required and a stress, so that even when the number of printing sheets is increased (particularly at a low print ratio), it is possible to considerably prevent a deterioration of the developer to suppress an increase in amount of fog due to the developer deterioration.

(Effect 2-2) <b) Fog Evaluation (When Toner is Short) in Table 1>

The developer is one component magnetic toner and is attracted to a developer-carrying member by a fixed magnetic field generation means disposed in the developer-carrying member, whereby the developer is magnetically conveyed onto the developer-carrying member. As a result, a developer supply roller for supplying the developer onto the developer-carrying member is not required, so that it is possible to considerably prevent a deterioration of the developer to suppress an increase in amount of fog by shaking a cartridge to mix the deteriorated developer and less deteriorated developer when the toner is short.

(Effect 3-2) <h) Evaluation of Defect in Halftone Image in Table 1>

The developer is one component magnetic toner and is attracted to a developer-carrying member by a fixed magnetic field generation means disposed in the developer-carrying member, whereby the developer is magnetically conveyed onto the developer-carrying member. As a result, a developer supply roller for supplying the developer onto the developer-carrying member is not required and a stress exerted on the toner is low, so that even when the number of printing sheets is increased, it is possible to suppress such an image defect that agglomeration of toner is formed on the developer supply roller by frictional contact of the developer supply roller with the developer-carrying member to be moved and deposited in the halftone image.

(Effect 4-2) <g) Toner Scattering Evaluation in Table 1>

The developer is one component magnetic toner and is attracted to a developer-carrying member by a fixed magnetic field generation means disposed in the developer-carrying member, whereby the developer is magnetically conveyed onto the developer-carrying member. As a result, even when a lowering in electrical charge imparting performance due to a deterioration of developer is caused to occur, the developer is constrained by the magnetic force, so that it is possible to suppress scattering of the developer toward the outside of a developer vessel.

(Effect 5-2) <c) Ghost Evaluation in Table 1>

The member to be developed is subjected to development with developer while the member to be developed is pressed by the developer-carrying member, and the developer is one component magnetic toner having an average circularity of less than 0.965 and is attracted to a developer-carrying member by a fixed magnetic field generation means disposed in the developer-carrying member. As a result, a developer which has been regulated in amount during the development has an amount per unit area of 8-15 g/m$^2$ and a specific charge of 13-23 μC/g, so that it becomes possible to effectively peel off and supply the toner to suppress development ghost.

(Effect 6-2) <Realization of Suppression of Fog in Effects 28 and 30 and Suppression of Ghost in Effect 33 in Combination>

The member to be developed is subjected to development with developer while the member to be developed is pressed by the developer-carrying member, and the developer is one component magnetic toner having an average circularity of not less than 0.970 and is attracted to a developer-carrying member by a fixed magnetic field generation means disposed in the developer-carrying member. As a result, a developer which has been regulated in amount during the development has an amount per unit area of 8-15 g/m$^2$ and a specific charge of 13-23 μC/g, so that it becomes possible to effectively peel off and supply the toner to suppress an increase in fog amount due to toner deterioration and suppress development ghost. Consequently, it is possible to compatibly realize suppression of fog amount and ghost image defect.

(Effect 7-2) <f) Evaluation of Solid White Image Failure in Table 1>

The member to be developed is subjected to development with developer while the member to be developed is pressed by the developer-carrying member, and the developer is one component magnetic toner having an average circularity of not less than 0.965 and is attracted to a developer-carrying member by a fixed magnetic field generation means disposed in the developer-carrying member. As a result, a developer which has been regulated in amount during the development has an amount per unit area of 5-14 g/m$^2$ and a specific charge of 13-23 μC/g, so that it becomes possible to effectively peel off and supply the toner, whereby it is possible to suppress solid white image defect.

(Effect 18-2) <d) Evaluation of Hair Line Uniformity in Table 1>

A member to be developed is subjected to development with developer while applying a direct-current (DC) voltage as a developing bias (voltage) and pressing the developer-carrying member against an image bearing member as the member to be charged, whereby tailing of toner is suppressed, thereby to improve a thin line uniformity.

(Effect 19-2) <e) Evaluation of Image Edge Defect in Table 1>

A member to be developed is subjected to development with developer while applying a direct-current (DC) voltage as a developing bias (voltage) and pressing the developer-carrying member against an image bearing member as the member to be charged, whereby an edge of a high-density portion particularly on a downstream side of the process is developed with a high density, and an edge of a halftone portion adjacent to the high-density portion is developed with a low density. As a result, it is possible to suppress an image edge defect.

(Effect 20-2) <A) Evaluation of Toner Collection (Cleanerless) in Table 1>

In a cleanerless system, an image bearing member and a developer-carrying member are pressed against each other, so that a distance therebetween becomes small to increase an area on which an electric field or a magnetic field acts and a strength of the electric field or the magnetic field. As a result, it is possible to improve a collection performance of developer remaining and deposited, after transfer, on an non-exposure portion of the image bearing member.

(Effect 21-2) <B) Evaluation of Defect in Halftone Image (Scheme 2) in Table 1>

In a cleanerless system, the developer is one component magnetic toner and is attracted to a developer-carrying member by a fixed magnetic field generation means disposed in the developer-carrying member, whereby the developer is magnetically conveyed onto the developer-carrying member. As a result, a developer supply roller for supplying the developer onto the developer-carrying member is not required, so that it is possible to suppress toner deterioration due to returned toner, an occurrence of agglomerated toner grown from a contaminant contained in the returned toner as a seed, and a defect in halftone image due to deposition of the agglomerated toner on the developer supply roller.

(Effect 22-2) <C) Evaluation of Defect in Halftone Image by Paper Dust in Table 1>

In a cleanerless system, the developer is one component magnetic toner and is attracted to a developer-carrying member by a fixed magnetic field generation means disposed in the developer-carrying member, whereby the developer is magnetically conveyed onto the developer-carrying member. As a result, a developer supply roller for supplying the developer onto the developer-carrying member is not required, so that even when the number of printing sheets is increased, it is possible to suppress such an image defect in halftone image occurring every full circumference of the developer-carrying member due to peeling-off and supply failure of the toner, caused by frictional contact between the developer supply roller and the developer-carrying member leading to residual paper dust, contained in the returned toner, remaining in the developer supply roller.

(Effect 23-2) <D) Evaluation of Defect in Solid Black Image in Table 1>

In a cleanerless system, a member to be developed is subjected to development with developer while applying a direct-current (DC) voltage as a developing bias (voltage) and pressing the developer-carrying member against an image bearing member as the member to be charged, whereby it is possible to suppress an image defect in a solid black image due to white spots therein by suppressing leakage generated through paper dust contained in the returned toner in a high-temperature and high-humidity environment.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 416768/2003 filed Dec. 15, 2003, which is hereby incorporated by reference.

What is claimed is:

1. A developing device comprising:

a rotatable developer carrying member for carrying a developer to develop an electrostatic image formed on an image bearing member with the developer;

non-rotatable magnetic field generating means, disposed inside said developer carrying member, for magnetically attracting the developer on said developer carrying member; and a regulating member for regulating an amount of the developer carried on said developer carrying member, wherein said developer carrying member is provided with an elastic surface layer, and said developer carrying member is provided so that said elastic surface layer presses the developer carried on said developer carrying member against said image bearing member, and wherein the developer is an one component magnetic toner having an average circularity not less than 0.965, and an amount of the developer per unit area of the developer regulated by said regulating member is 5-14 $g/m^2$, and an amount of electric charge thereof is 10-50 μC/g.

2. A device according to claim 1, wherein the amount of electric charge is 10-45 μC/g.

3. A device according to claim 1, wherein the one component magnetic toner has the average circularity of not less than 0.970.

4. A device according to claim 1, wherein a ratio (B/A) is not more than 0.001, where the ratio (B/A) is between the content (A) of carbon element existing at the surface of the magnetic toner particle and the content of iron element (B), measured by X-ray photoelectron spectrum analysis.

5. A device according to claim 1, wherein said developer carrying member is supplied with a DC voltage during a developing operation.

6. A device according to claim 1, wherein said elastic surface layer has a microhardness of 40-98°.

7. A device according to claim 1, wherein said developing device is contained in a cartridge detachably mountable to a main assembly of an image forming apparatus.

8. A device according to claim 1, wherein said developing device is contained, together with said image bearing member, in a cartridge detachably mountable to a main assembly of an image forming apparatus.

9. A device according to claim 1, wherein said developing device is capable of collecting the developer remaining on said image bearing member after the image is transferred from said image bearing member on the transfer member.

10. A developing device comprising:

a rotatable developer carrying member for carrying a developer to develop an electrostatic image formed on an image bearing member with the developer;

non-rotatable magnetic field generating means, disposed inside said developer carrying member, for magnetically attracting the developer on said developer carrying member; and a regulating member for regulating an amount of the developer carried on said developer carrying member, wherein said developer carrying member is provided with an elastic surface layer, and said developer carrying member is provided so that said elastic surface layer presses the developer carried on said developer carrying member against said image bearing member, and wherein the developer is an one component magnetic toner having an average circularity less than 0.965, and an amount of the developer per unit area of the developer regulated by said regulating member is 8-15 $g/m_2$, and an amount of electric charge thereof is 13-23 μC/g.

11. A device according to claim 10, wherein the developer has an average circularity of not less than 0.92.

12. A device according to claim 10, wherein a ratio (B/A) is not more than 0.001, where the ratio (B/A) is between the content (A) of carbon element existing at the surface of the magnetic toner particle and the content (B) of iron element, measured by X-ray photoelectron spectrum analysis.

13. A device according to claim 10, wherein said developer carrying member is supplied with a DC voltage during a developing operation.

14. A device according to claim 10, wherein said elastic layer has a microhardness of 40-98°.

15. A device according to claim 10, wherein said developing device is contained in a cartridge detachably mountable to a main assembly of an image forming apparatus.

16. A device according to claim 10, wherein said developing device is contained, together with said image bearing member, in a cartridge detachably mountable to a main assembly of an image forming apparatus.

17. A device according to claim 10, wherein said developing device is capable of collecting the developer remaining on said image bearing member after the image is transferred from said image bearing member on the transfer member.

18. An apparatus according to claim 1, wherein said elastic surface layer has a thickness of 50-2000 μm.

19. An apparatus according to claim 10, wherein said elastic surface layer has a thickness of 50-2000 μm.

* * * * *

UNITED STATES PATENT AND TRADEMARK OFFICE

CERTIFICATE OF CORRECTION

PATENT NO. : 7,233,758 B2
APPLICATION NO. : 11/011119
DATED : June 19, 2007
INVENTOR(S) : Hikaru Osada et al.

It is certified that error appears in the above-identified patent and that said Letters Patent is hereby corrected as shown below:

ON THE TITLE PAGE

At Item (56), Foreign Patent Documents, "2003043736 A" should read --2003-043736 A--; and 2001235897 A" should read --2001-235897 A--;

At Item (56), Other Publications, after Patent Abstracts (second occurrence): "No. 2002365828," should read --No. 2002-365828--;

At Item (57), Abstract, line 12, "is an" should read --is a--.

IN THE DRAWINGS

Sheet 8, Fig. 8, "ELECTRON MTR" should read --ELECTROMETER--; and "INSULTIVE" should read --INSULATIVE--.

COLUMN 2

Line 25, "sometime" should read --sometimes--; and
Line 65, "certain in" should read --in certain--.

COLUMN 3

Line 21, "hot" should read --not--.

COLUMN 5

Line 27, "drawing" should read --drawing of--.

COLUMN 7

Line 20, "S" should be deleted;
Line 57, "comprises;" should read --comprises:--; and
Line 65, "a" should read --an--.

COLUMN 10

Line 41, "determined" should read --determined.--.

COLUMN 11

Line 14, "an" should read --a--;
Line 18, "methods" should read --method--;
Line 30, "circumferene" should read --circumference--; and
Line 35, "Cirdularity" should read --Circularity--.

UNITED STATES PATENT AND TRADEMARK OFFICE

CERTIFICATE OF CORRECTION

PATENT NO. : 7,233,758 B2
APPLICATION NO. : 11/011119
DATED : June 19, 2007
INVENTOR(S) : Hikaru Osada et al.

It is certified that error appears in the above-identified patent and that said Letters Patent is hereby corrected as shown below:

COLUMN 12

Line 25, “its” should read --is--;
Line 44, “only” should read --one--;
Line 45, “an” should read --a--;
Line 65, “only” should read --one--; and
Line 66, “an” should read --a--.

COLUMN 13

Line 4, “similarly” should read --similar--;
Line 50, “used to hear” should read --used here--; and
Line 60, “home” should read --of--.

COLUMN 14

Line 2, “sleeve” should read --sleeve.--;
Line 9, “it” should read --is--;
Line 40, “contacted” should read --contacted to--; and
Line 63, “60rl.” should read --60r.--.

COLUMN 15

Line 12, “of” should be deleted; and
Line 47, “it” should read --is--.

COLUMN 16

Line 4, “document” should read --relative--.

COLUMN 18

Line 26, “describe” should read --described--.

COLUMN 20

Line 15, “an one” should read --is--; and
Line 22, “it” should read --is--.

COLUMN 22

Line 9, “image” should read --images--;
Line 11, “one one” should read --one of--; and
Line 22, Table 1, “Circurality” should read --Circularity--.

UNITED STATES PATENT AND TRADEMARK OFFICE

CERTIFICATE OF CORRECTION

PATENT NO. : 7,233,758 B2
APPLICATION NO. : 11/011119
DATED : June 19, 2007
INVENTOR(S) : Hikaru Osada et al.

It is certified that error appears in the above-identified patent and that said Letters Patent is hereby corrected as shown below:

COLUMN 23

Line 56, “scheme i” should read --scheme 1--; and
Line 66, “not” should read --no--.

COLUMN 24

Line 51, “scattering” should read --scattering.--.

COLUMN 25

Line 6, “are” should read --have--; and
Line 7, “slightly” should read --slight--.

COLUMN 28

Line 30, “replace d” should read --replaced--, and “so that difference” should read --so that the difference--;
Line 31, “is consumed.” should read --is consumed is large.--;
Line 36, “replace” should read --replacement--;
Line 46, “improvement” should read --improve--;
Line 48, “examples, 12,” should read --example 12,--;
Line 54, “10s,” should read --10,--; and
Line 65, “charge” should read --charges--.

COLUMN 29

Line 21, “replace” should read --replacement--; and
Line 66, “accomplishment” should read --accomplished--.

COLUMN 31

Line 52, “If the amount of coating toner,” should read --If the amount of coating toner is too large,--; and “replace” should read --replacement--.

COLUMN 32

Line 2, “is” should read --is in a--;
Line 12, “preferable is” should read --is--;
Line 14, “replace” should read --replacement--; and
Line 38, “evaluation” should read --evaluations--.

COLUMN 33

Line 12, “0.2μ.” should read --0.2μm.--;
Line 48, Table 4, “stipes” should read --stripes--; and
Line 50, Table 4, “imge” should read --image--.

UNITED STATES PATENT AND TRADEMARK OFFICE

CERTIFICATE OF CORRECTION

PATENT NO. : 7,233,758 B2
APPLICATION NO. : 11/011119
DATED : June 19, 2007
INVENTOR(S) : Hikaru Osada et al.

It is certified that error appears in the above-identified patent and that said Letters Patent is hereby corrected as shown below:

COLUMN 34

Line 38, “and the embed” should be deleted.

Line 39, “ded in g and slipping off” should read --and the embedding and slipping-off--; and Line 54, “are” should read --is--.

COLUMN 35

Line 3, “is” should be deleted; and

Line 5, “faithfull” should read --faithful--.

COLUMN 36

Line 1, “suggest” should read --suggests--;

Line 19, “0965,” should read --0.965,--;

Line 41, “time,” should read --time, and--; and

Line 52, “It” should read --If--.

COLUMN 37

Line 1, “analysis)” should read --analysis--;

Line 8, “able” should read --ably--;

Line 15, “leads” should read --lead--;

Line 33, “limitedly” should read --limited--; and

Line 41, “0.965.” should read --0.965:--.

COLUMN 41

Line 12, “lo” should be deleted; and

Line 39, “an” should read --a--.

COLUMN 43

Line 2, “n” should read --in--.

COLUMN 45

Line 1, “an” should read --a--.

COLUMN 46

Line 6, “an” should read --a--;

Line 53, “an” should read --a--; and

Line 56, “8-15 $g/m_2$,” should read --8-15$g/m^2$,--.

UNITED STATES PATENT AND TRADEMARK OFFICE

CERTIFICATE OF CORRECTION

PATENT NO. : 7,233,758 B2
APPLICATION NO. : 11/011119
DATED : June 19, 2007
INVENTOR(S) : Hikaru Osada et al.

It is certified that error appears in the above-identified patent and that said Letters Patent is hereby corrected as shown below:

COLUMN 48

Line 8, "An apparatus" should read --A device--.

Signed and Sealed this

Twenty-seventh Day of May, 2008

JON W. DUDAS
*Director of the United States Patent and Trademark Office*